US006171215B1

(12) United States Patent
Stearns et al.

(10) Patent No.: US 6,171,215 B1
(45) **Date of Patent: *Jan. 9, 2001**

(54) EXERCISE METHODS AND APPARATUS

(76) Inventors: Kenneth W. Stearns, P.O. Box 55912, Houston, TX (US) 77055; Joseph D. Maresh, P.O. Box 645, West Linn, OR (US) 97068-0645

( * ) Notice: Under 35 U.S.C. 154(b), the term of this patent shall be extended for 0 days.

This patent is subject to a terminal disclaimer.

(21) Appl. No.: 09/072,765

(22) Filed: May 5, 1998

Related U.S. Application Data

(63) Continuation-in-part of application No. 08/839,990, filed on Apr. 24, 1997, and a continuation-in-part of application No. 09/064,393, filed on Apr. 22, 1998

(60) Provisional application No. 60/067,504, filed on Dec. 4, 1997, provisional application No. 60/075,702, filed on Feb. 24, 1998, and provisional application No. 60/075,703, filed on Feb. 24, 1998.

(51) Int. Cl.[7] ..... A63B 22/04

(52) U.S. Cl. ..... 482/51; 482/70

(58) Field of Search ..... 482/51, 52, 57, 482/79, 80, 70

(56) References Cited

U.S. PATENT DOCUMENTS

| | | | | |
|---|---|---|---|---|
| 5,562,574 | * | 10/1996 | Miller | 482/57 |
| 5,653,662 | * | 8/1997 | Rodgers, Jr. | 482/52 |
| 5,762,588 | * | 6/1998 | Chen | 482/57 |
| 5,779,599 | * | 7/1998 | Chen | 482/70 |
| 5,792,026 | * | 8/1998 | Maresh et al. | 482/51 |
| 5,803,871 | * | 9/1998 | Stearns et al. | 482/70 |
| 5,848,954 | * | 12/1998 | Stearns et al. | 482/70 |
| 5,857,941 | * | 1/1999 | Maresh et al. | 482/70 |
| 5,879,271 | * | 3/1999 | Stearns et al. | 482/57 |

* cited by examiner

*Primary Examiner*—Stephen R. Crow

(57) ABSTRACT

An exercise apparatus links rotation of a crank to generally elliptical motion of a foot supporting member. A foot supporting linkage is movably connected between a rocker and a crank in such a manner that the foot supporting member moves through a range of motion greater in length than the distance between the points of connection to the crank.

23 Claims, 35 Drawing Sheets

Fig. 16
Fig. 18
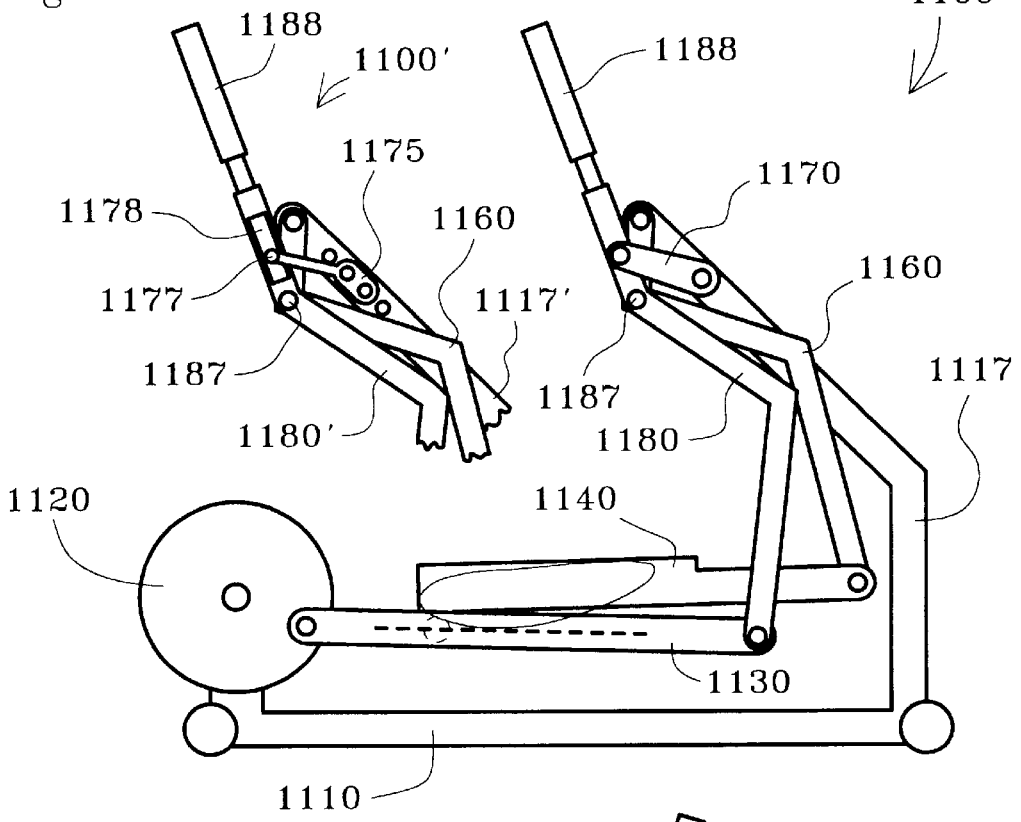
Fig. 17
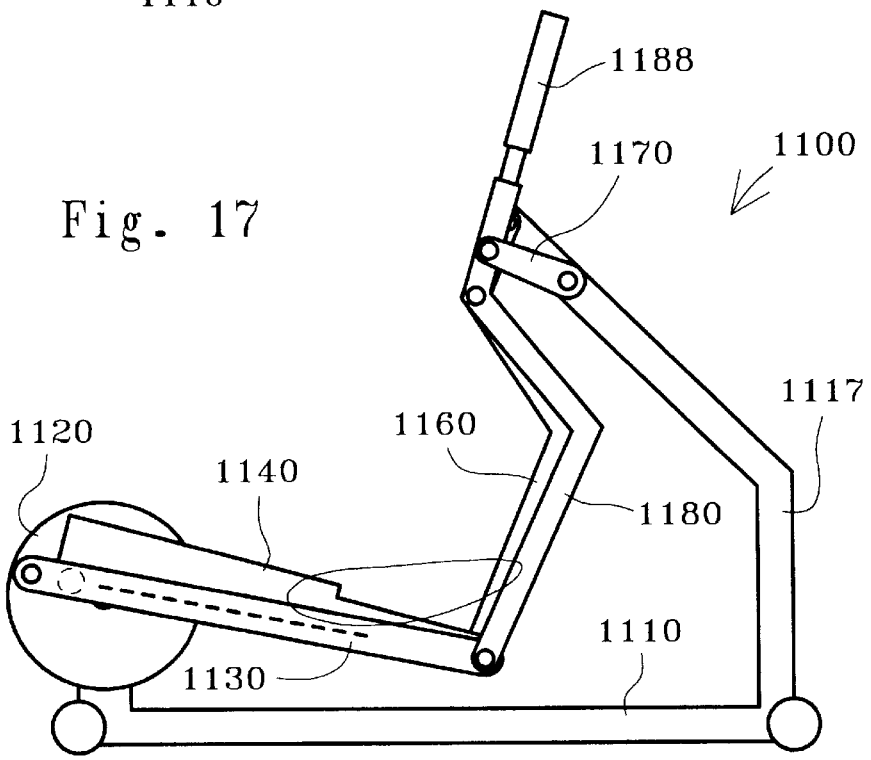

EXERCISE METHODS AND APPARATUS

CROSS-REFERENCE TO RELATED APPLICATIONS

This application is a continuation-in-part of both U.S. patent application Ser. No. 08/839,990, which was filed on Apr. 24, 1997, and U.S. patent application Ser. No. 09/064,393, which was filed on Apr. 22, 1998; and also discloses subject matter entitled to the earlier filing dates of Provisional Application Ser. No. 60/067,504, which was filed on Dec. 4, 1997, and Provisional Application Ser. Nos. 60/075,702 and 60/075,703, which were filed on Feb. 24, 1998.

FIELD OF THE INVENTION

The present invention relates to exercise methods and apparatus and more particularly, to exercise equipment which facilitates exercise through a curved path of motion.

BACKGROUND OF THE INVENTION

Exercise equipment has been designed to facilitate a variety of exercise motions. For example, treadmills allow a person to walk or run in place; stepper machines allow a person to climb in place; bicycle machines allow a person to pedal in place; and other machines allow a person to skate and/or stride in place. Yet another type of exercise equipment has been designed to facilitate relatively more complicated exercise motions and/or to better simulate real life activity. Such equipment typically converts a relatively simple motion, such as circular, into a relatively more complex motion, such as elliptical.

One shortcoming of these prior art elliptical motion exercise machines is that a direct relationship exists between the length of foot travel and the height of foot travel. In other words, an adjustment which would increase the length of foot travel necessarily increases the height of foot travel, as well. Unfortunately, this fixed aspect ratio is contrary to real life activity. In particular, a person does not lift his legs higher and higher to take strides which are longer and longer. Therefore, a need exists for an improved elliptical motion exercise machine which does not impose an unnatural aspect ratio between stride length and stride height.

SUMMARY OF THE INVENTION

The present invention may be seen to provide a novel linkage assembly and corresponding exercise apparatus suitable for linking circular motion to relatively more complex, generally elliptical motion. Left and right cranks are rotatably mounted on a frame and provide axially extending supports which are disposed a crank diameter apart from one another. Left and right foot supporting linkages are movably interconnected between the frame and respective crank supports in such a manner that rotation of the cranks is linked to movement of left and right foot supports through a vertical range of motion which is shorter than the crank diameter and through a horizontal range of motion which is longer than the crank diameter.

In another respect, the present invention may be seen to provide a novel linkage assembly and corresponding exercise apparatus suitable for linking reciprocal motion to relatively more complex, generally elliptical motion. For example, left and right handlebar links may be rotatably connected to the frame and linked to at least one link in the linkage assembly. As the foot supports move through their generally elliptical paths, the handlebars pivot back and forth relative to the frame.

In yet another respect, the present invention may be seen to provide a novel linkage assembly and corresponding exercise apparatus suitable for adjusting the angle of the generally elliptical paths of motion relative to a floor surface on which the apparatus rests. For example, the part of the frame which supports the foot supporting linkages and/or the handlebars may be selectively locked in any of a plurality of positions relative to an underlying base on the floor surface.

In still another respect, the present invention may be seen to provide a novel linkage assembly and corresponding exercise apparatus suitable for adjusting the configuration of the generally elliptical paths of motion. For example, a bar in each of the foot supporting linkages may be adjusted relative to a respective handlebar or another bar in the same linkage to alter its affect on a respective foot support. Many of the advantages of the present invention may become apparent from the more detailed description that follows.

BRIEF DESCRIPTION OF THE DRAWING

With reference to the Figures of the Drawing, wherein like numerals represent like parts and assemblies throughout the several views.

FIG. 16 is a side view of yet another exercise apparatus constructed according to the principles of the present invention;

FIG. 17 is a side view of the exercise apparatus of FIG. 16 at a different point in an exercise cycle;

FIG. 18 is a side view of an alternative linkage suitable for use on the exercise apparatus of FIG. 16;

DETAILED DESCRIPTION OF THE PREFERRED EMBODIMENT

Figure 1:
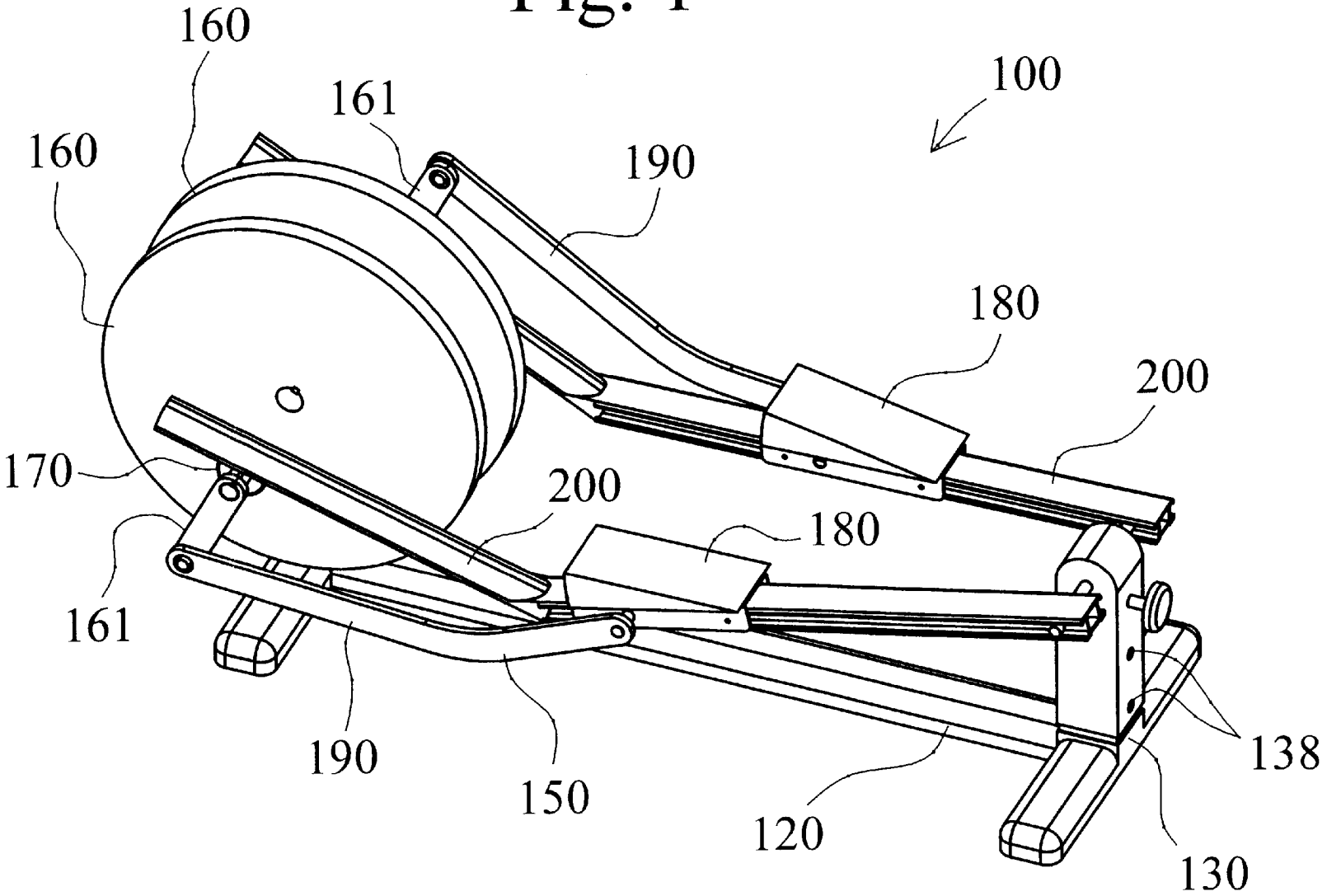
FIG. 1 is a perspective view of an exercise apparatus constructed according to the principles of the present invention.
Figure 2:
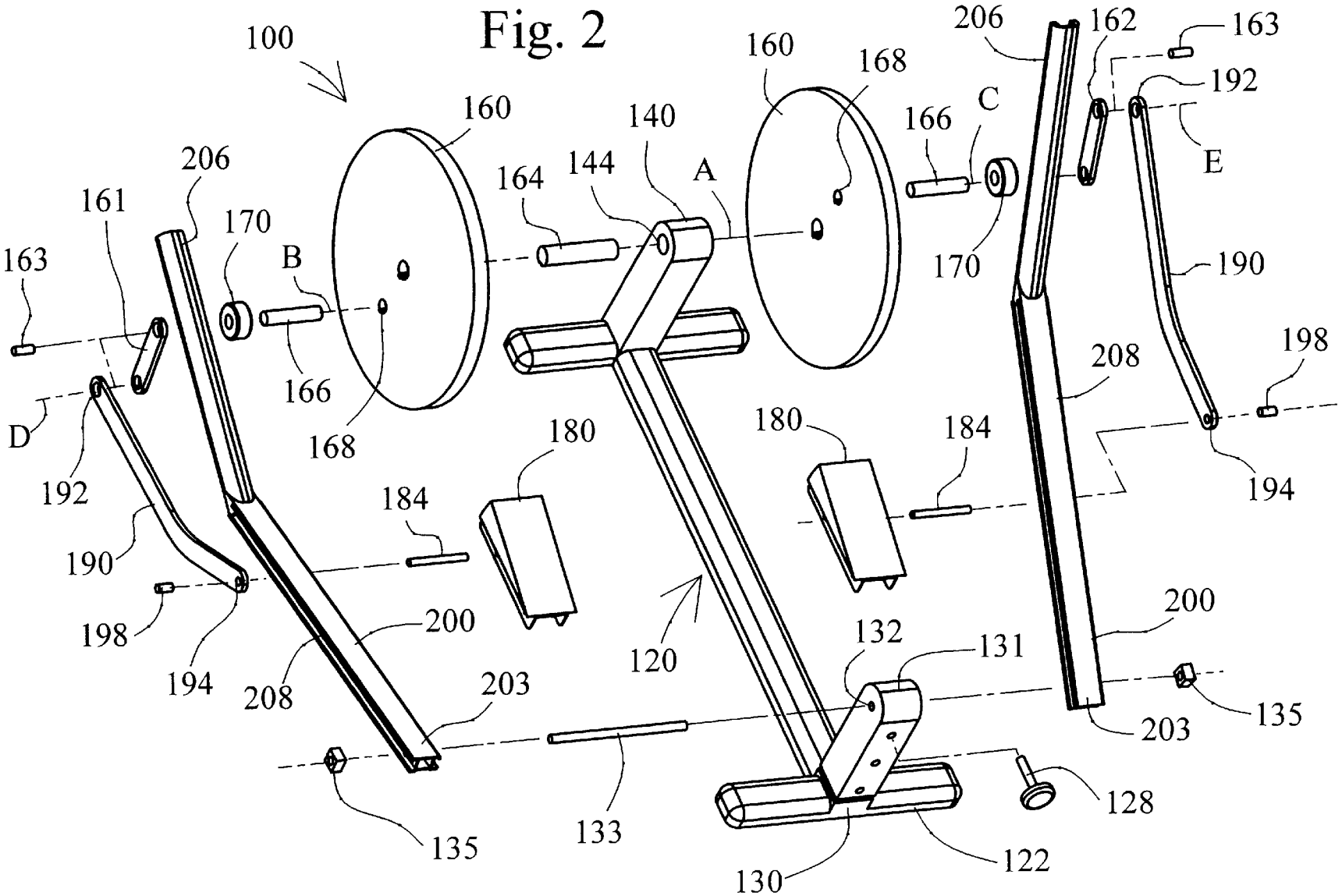
FIG. 2 is an exploded perspective view of the exercise apparatus of FIG. 1.
Figure 3:
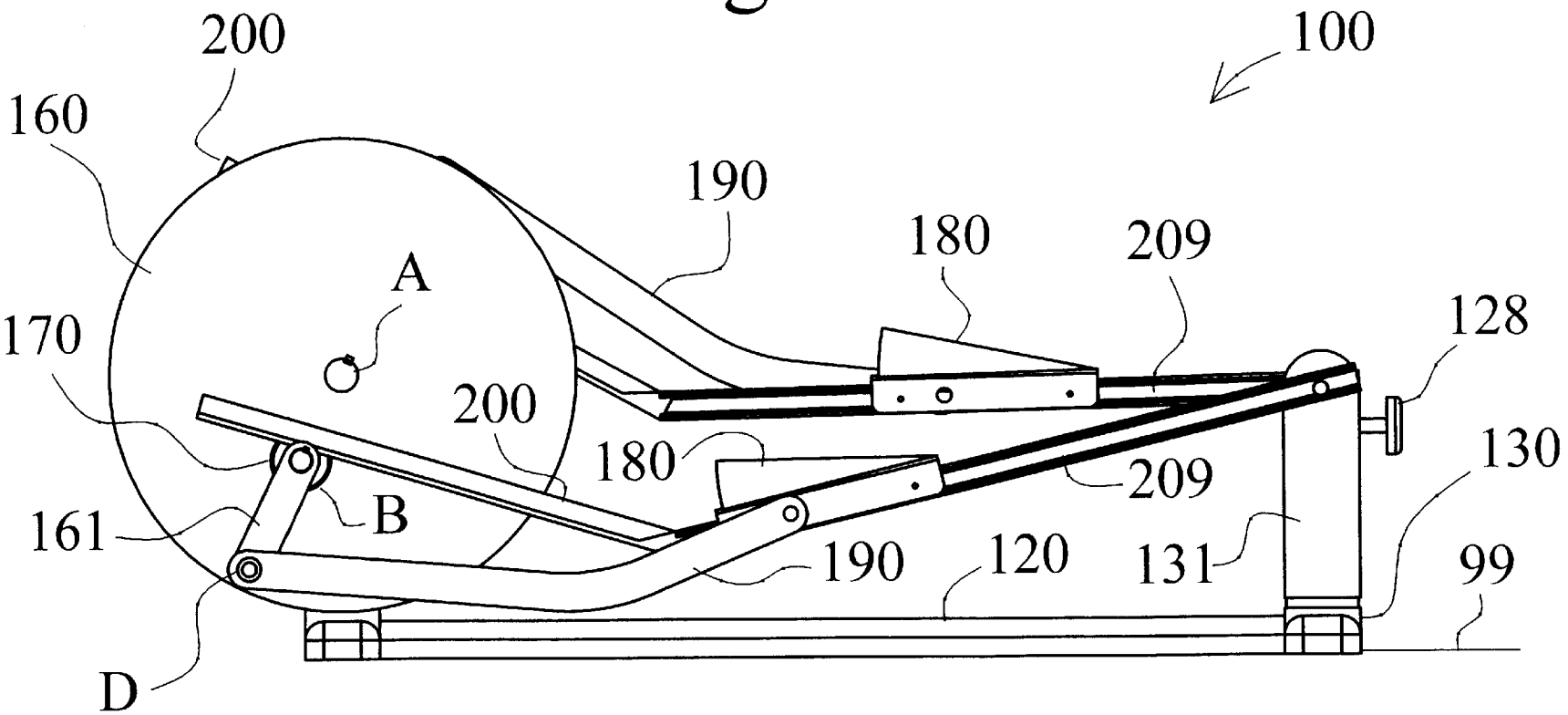
FIG. 3 is a side view of the exercise apparatus of FIG. 1.
Figure 4:
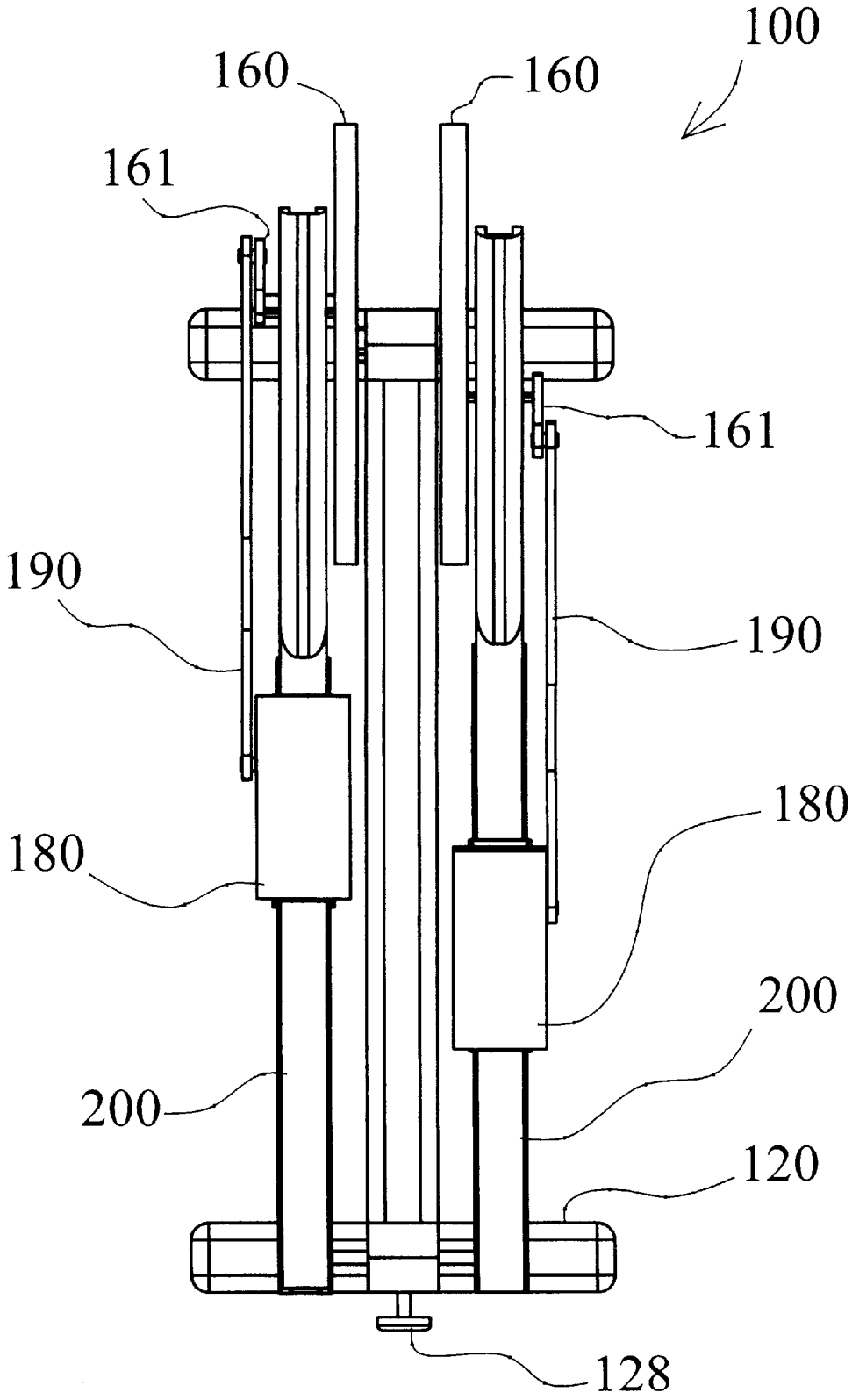
FIG. 4 is a top view of the exercise apparatus of FIG. 1.
Figure 5:
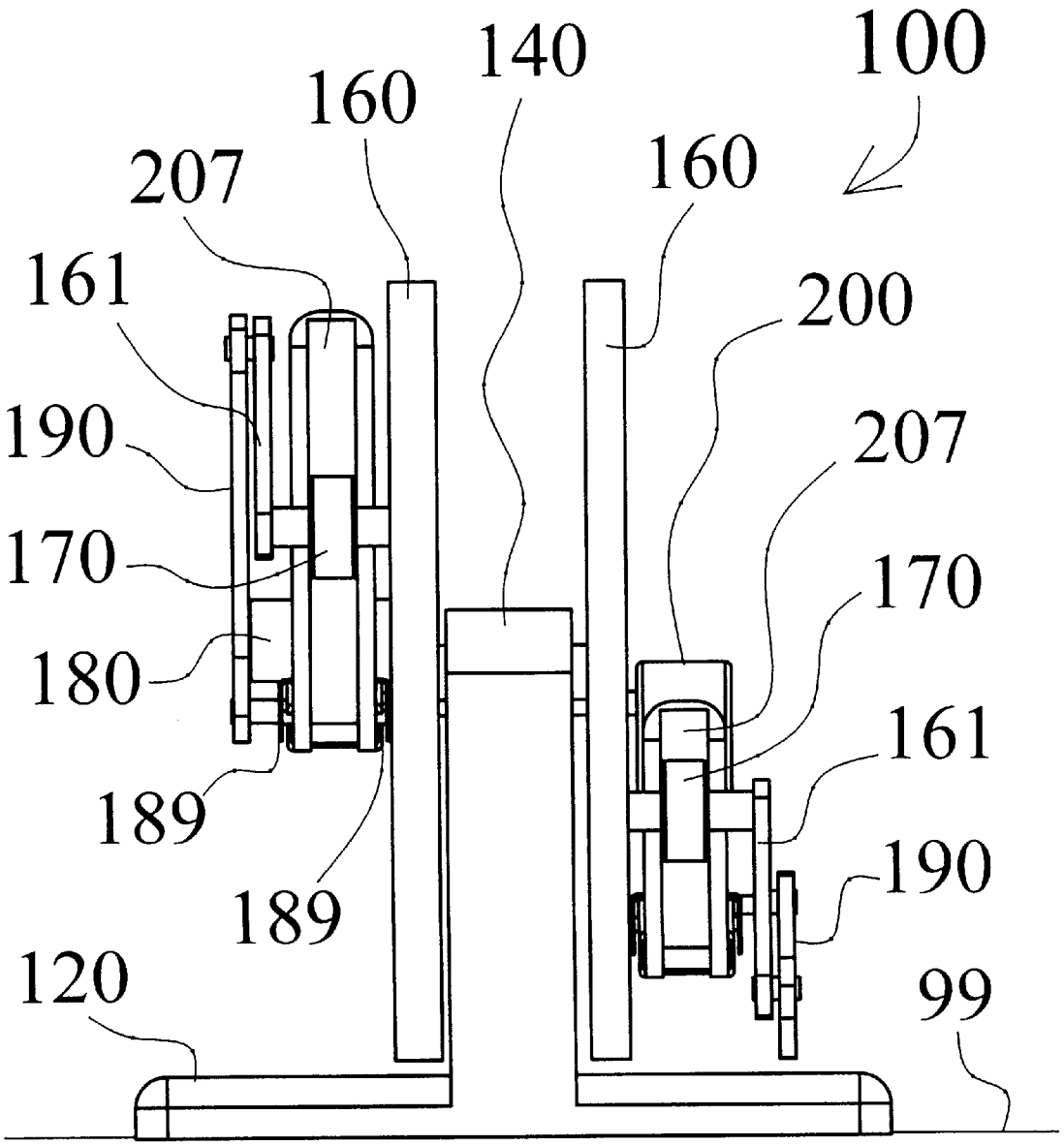
FIG. 5 is a rear view of the exercise apparatus of FIG. 1.
Figure 6A:
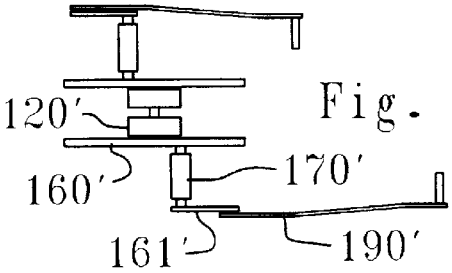
FIG. 6A is a top view of part of the linkage assembly on the exercise apparatus of FIG. 1.
Figure 6B:
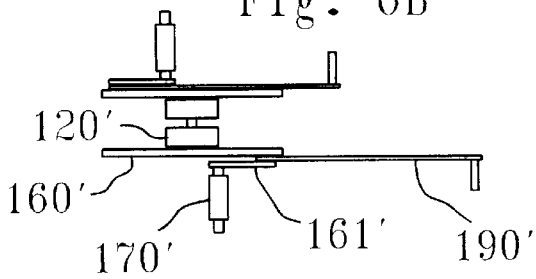
FIG. 6B is a top view of a linkage assembly similar to that of FIG. 6A, showing a second, discrete arrangement of the linkage assembly components.
Figure 6C:
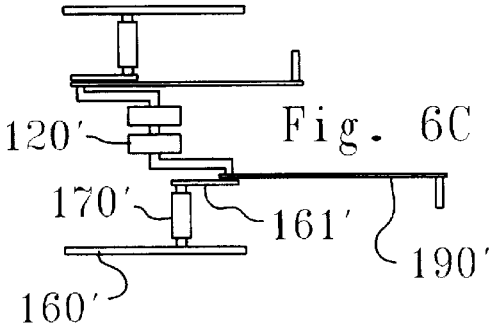
FIG. 6C is a top view of a linkage assembly similar to that of FIG. 6A, showing a third, discrete arrangement of the linkage assembly components.
Figure 6D:
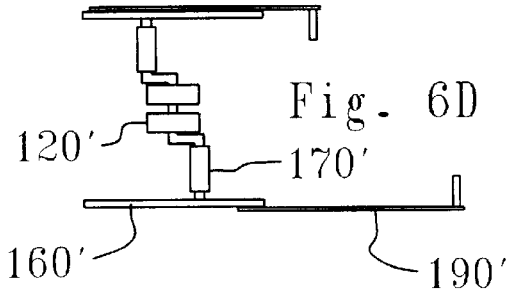
FIG. 6D is a top view of a linkage assembly similar to that of FIG. 6A, showing a fourth, discrete arrangement of the linkage assembly components.
Figure 6E:
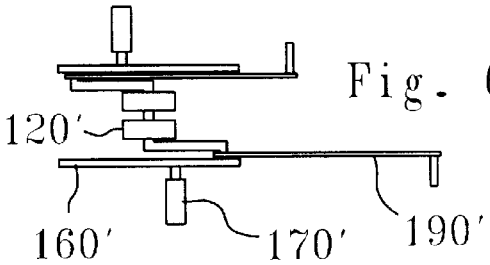
FIG. 6E is a top view of a linkage assembly similar to that of FIG. 6A, showing a fifth, discrete arrangement of the linkage assembly components.
Figure 6F:
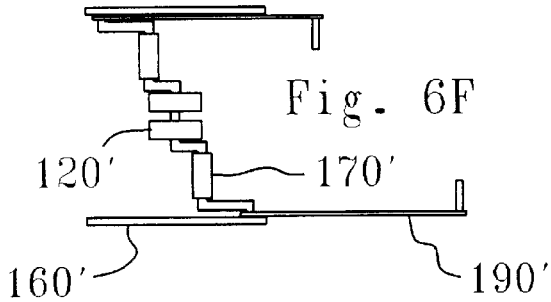
FIG. 6F is a top view of a linkage assembly similar to that of FIG. 6A, showing a sixth, discrete arrangement of the linkage assembly components.
Figure 6G:
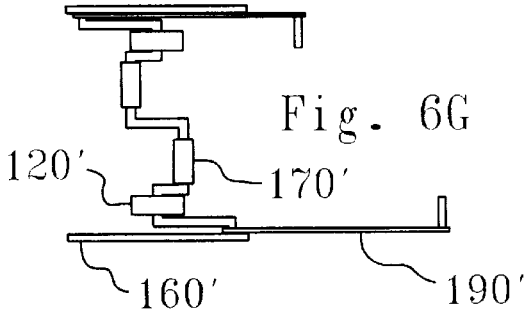
FIG. 6G is a top view of a linkage assembly similar to that of FIG. 6A, showing a seventh, discrete arrangement of the linkage assembly components.
Figure 6H:
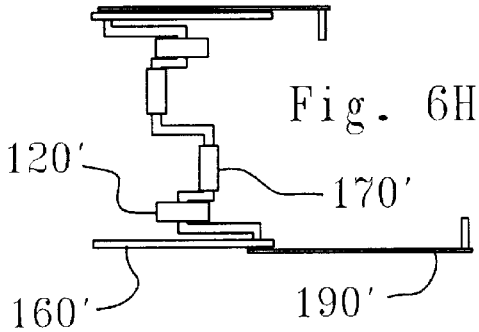
FIG. 6H is a top view of a linkage assembly similar to that of FIG. 6A, showing an eighth, discrete arrangement of the linkage assembly components.
Figure 6I:
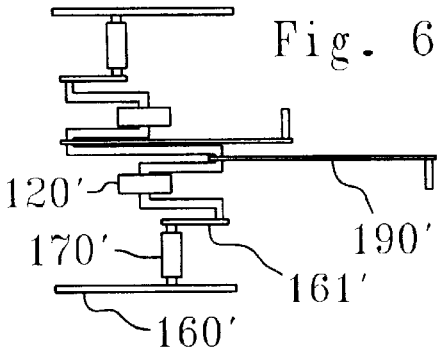
FIG. 6I is a top view of a linkage assembly similar to that of FIG. 6A, showing a ninth, discrete arrangement of the linkage assembly components.
Figure 6J:
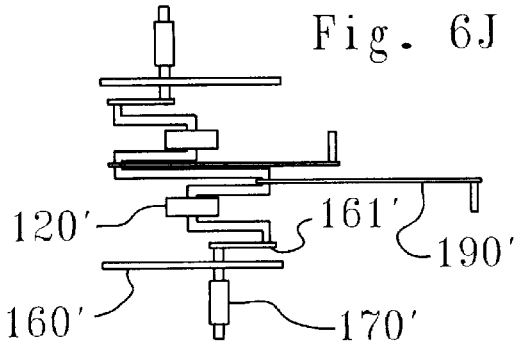
FIG. 6J is a top view of a linkage assembly similar to that of FIG. 6A, showing a tenth, discrete arrangement of the linkage assembly components.

The present invention provides various elliptical motion exercise machines which link rotation of left and right cranks to generally elliptical motion of respective left and right foot supports. The term "elliptical motion" is intended in a broad sense to describe a closed path of motion having a relatively longer first axis and a relatively shorter second axis (which extends perpendicular to the first axis). In general, the machines may be said to use the cranks themselves to move the foot supports in a direction parallel to the second axis and crank driven links to move the foot supports in a direction parallel to the first axis. A general characteristic of such machines is that the first axis may be longer than a crank diameter defined between the left and right cranks.

The embodiments shown and/or described herein are generally symmetrical about a vertical plane extending lengthwise through a floor-engaging base (perpendicular to the transverse ends thereof), the primary exception being the relative orientation of certain parts of the linkage assembly on opposite sides of the plane of symmetry. In general, the "right-hand" components are one hundred and eighty degrees out of phase relative to the "left-hand" components. However, like reference numerals are used to designate both the "right-hand" and "left-hand" parts, and when reference is made to one or more parts on only one side of an apparatus, it is to be understood that corresponding part(s) are disposed on the opposite side of the apparatus. The portions of the frame which are intersected by the plane of symmetry exist individually and thus, do not have any "opposite side" counterparts. Also, to the extent that reference is made to forward or rearward portions of an apparatus, it is to be understood that a person can typically exercise on the apparatus while facing in either direction relative to the linkage assembly.

Many of the disclosed embodiments may be modified by the addition and/or substitution of various known inertia altering devices, including, for example, a motor, a "stepped up" flywheel, or an adjustable brake of some sort. Moreover, although many of the rotationally interconnected components are shown to be cantilevered relative to one another, many such components may be modified so that an end of a first component nests between opposing prongs on the end of a second component. Furthermore, when a particular feature or suitable alternative is described with reference to a particular embodiment, it is to be understood that similar modifications may be applied to other embodiments, as well.

A first exercise apparatus constructed according to the principles of the present invention is designated as 100 in FIGS. 1–5. The apparatus 100 generally includes a frame 120 and a linkage assembly 150 movably mounted on the frame 120. Generally speaking, the linkage assembly 150 moves relative to the frame 120 in a manner that links rotation of a flywheel 160 to generally elliptical motion of a force receiving member 180.

The frame 120 includes a base 122, a forward stanchion 130, and a rearward stanchion 140. The base 122 may be described as generally I-shaped and is designed to rest upon a generally horizontal floor surface 99 (see FIGS. 3 and 5). The forward stanchion 130 extends perpendicularly upward from the base 122 and supports a telescoping tube 131. A plurality of holes 138 are formed in the tube 131, and a single hole is formed in the upper end of the stanchion 130 to selectively align with any one of the holes 138. A pin 128, having a ball detent, may be inserted through an aligned set of holes to secure the tube 131 in a raised position relative to the stanchion 130. A laterally extending hole 132 is formed through the tube 131.

The rearward stanchion 140 extends perpendicularly upward from the base 122 and supports a bearing assembly. An axle 164 is inserted through a laterally extending hole 144 in the bearing assembly to support a pair of flywheels 160 in a manner known in the art. For example, the axle 164 may be inserted through the hole 144, and then a flywheel 160 may be keyed to each of the protruding ends of the axle 164, on opposite sides of the stanchion 140. Those skilled in the art will recognize that the flywheels 160 could be replaced by some other rotating member(s) which may or may not, in turn, be connected to one or more flywheels. These rotating members 160 rotate about an axis designated as A.

A radially displaced shaft 166 is rigidly secured to each flywheel 160 by means known in the art. For example, the shaft 166 may be inserted into a hole 168 in the flywheel 160 and welded in place. The shaft 166 is secured to the flywheel 160 at a point radially displaced from the axis A, and thus, the shaft 166 rotates at a fixed radius about the axis A. In other words, the shaft 166 and the flywheel 160 cooperate to define a first crank having a first crank radius.

A roller 170 is rotatably mounted on each shaft 166. The roller 170 on the right side of the apparatus 100 rotates about an axis B, and the roller 170 on the left side of the apparatus 100 rotates about an axis C. A rigid member or crank arm 161 is fixedly secured to each shaft 166 by means known in the art. For example, the shaft 166 may be inserted into a hole in the rigid member 161 and then keyed in place. The roller 170 is retained on the shaft 166 between the flywheel 160 and the rigid member 161.

Each rigid member 161 extends from the shaft 166 to a distal end 162 which occupies a position radially displaced from the axis A and rotates at a fixed radius about the axis A. In other words, the distal end 162 and the flywheel 160, together with the parts interconnected therebetween, cooperate to define an effective crank radius which is longer than that defined between the crank axis A and the shaft 166. In other words, the first crank and the second crank are portions of a single unitary member which is connected to the flywheel 160 by shaft 166, and they share a common rotational axis A.

A link 190 has a rearward end 192 rotatably connected to the distal end 162 of the member 161 by means known in the art. For example, holes may be formed through distal end 162 and the rearward end 192, and a rivet-like fastener 163 may inserted through the holes and secured therebetween. As a result of this arrangement, the link 190 on one side of the apparatus 100 rotates about an axis D relative to a respective distal end 162 and flywheel 160; and the link 190 on the other side of the apparatus 100 rotates about an axis E relative to a respective distal end 162 and flywheel 160. On the apparatus 100, the axes A, B, and D may be said to be radially aligned, and the axes A, C, and E may be said to be radially aligned. Also, the axes B and D may be said to be diametrically opposed from the axes C and E.

Each link 190 has a forward end 194 rotatably connected to a respective force receiving member 180 by means known in the art. For example, a pin 184 may be secured to the force receiving member 180, and a hole may be formed through the forward end 194 of the link 190 to receive the pin 184. A nut 198 may then be threaded onto the distal end of the pin 184. As a result of this arrangement, the link 190 may be said to be rotatably interconnected between the flywheel 160 and the force receiving member 180, and/or to provide a discrete means for interconnecting the flywheel 160 and the force receiving member 180.

Each force receiving member 180 is rollably mounted on a respective rail or track 200 and thus, may be described as a skate or truck. Each force receiving member 180 provides an upwardly facing support surface 188 sized and configured to support a person's foot.

Each rail 200 has a forward end 203, a rearward end 206, and an intermediate portion 208. The forward end 203 of each rail 200 is movably connected to the frame 120, forward of the flywheels 160. In particular, each forward end 203 is rotatably connected to the forward stanchion 130 by means known in the art. For example, a shaft 133 may be inserted into the hole 132 through the tube 131 and into holes through the forward ends 203 of the rails 200. The shaft 133 may be keyed in place relative to the stanchion 130, and nuts 135 may be secured to opposite ends of the shaft 133 to retain the forward ends 203 on the shaft 133. As a result of this arrangement, the rail 200 may be said to provide a discrete means for movably interconnecting the force receiving member 180 and the frame 120.

The rearward end 206 of the rail 200 is supported or carried by the roller 170. In particular, the rearward end 206 may be generally described as having an inverted U-shaped profile into which an upper portion of the roller 170 protrudes. The "base" of the inverted U-shaped profile is defined by a flat bearing surface 207 which bears against or rides on the cylindrical surface of the roller 170. Those skilled in the art will recognize that other structures (e.g. studs) could be substituted for the rollers 170. In any case, the rail 200 may be said to provide a discrete means for movably interconnecting the flywheel 160 and the force receiving member 180.

The intermediate portion 208 of the rail 200 may be defined as that portion of the rail 200 along which the skate 180 may travel and/or as that portion of the rail 200 between the rearward end 206 (which rolls over the roller 170) and the forward end 203 (which is rotatably mounted to the frame 120). The intermediate portion 208 may be generally described as having an I-shaped profile or as having a pair of C-shaped channels which open away from one another. Each channel 209 functions as a race or guide for one or more rollers 189 rotatably mounted on each side of the foot skate 180. Those skilled in the art will recognize that other structures (e.g. bearings) could be substituted for the rollers 189.

On the apparatus 100, both the end portion 206 and the intermediate portion 208 of the support member 200 are linear. However, either or both may be configured as a curve without departing from the scope of the present invention. Moreover, although the end portion 206 is fixed relative to the intermediate portion 208, an orientation adjustment could be provided on an alternative embodiment, as well.

Those skilled in the art will also recognize that each of the components of the linkage assembly 150 is necessarily long enough to facilitate the depicted interconnections. For example, the members 161 and the links 190 must be long enough to interconnect the flywheel 160 and the force receiving member 180 and accommodate a particular crank radius. Furthermore, for ease of reference in both this detailed description and the claims set forth below, linkage components are sometimes described with reference to "ends" being connected to other parts. For example, the link 190 may be said to have a first end rotatably connected to the member 161 and a second end rotatably connected to the force receiving member 180. However, those skilled in the art will recognize that the present invention is not limited to links which terminate immediately beyond their points of connection with other parts. In other words, the term "end" should be interpreted broadly, in a manner that could include "rearward portion", for example; and in a manner wherein "rear end" could simply mean "behind an intermediate portion", for example.

Those skilled in the art will further recognize that the above-described components of the linkage assembly 150 may be arranged in a variety of ways. For example, in each of FIGS. 6A–6J, flywheels 160', support rollers 170', members 161', and links 190' are shown in several alternative configurations relative to one another and the frame 120' (in some embodiments, there is no need for a discrete part 161' because both the links 190' and the rollers 170' are connected directly to the flywheels 160').

In operation, rotation of the flywheel 160 causes the shaft 166 to revolve about the axis A, thereby pivoting the rail 200 up and down relative to the frame 120, through a range of motion which is less than or equal to twice the radial distance between the axis A and either axis B or C (the crank diameter). Rotation of the flywheel 160 also causes the distal end 162 of the member 161 to revolve about the axis A, thereby moving the force receiving member 180 back and forth along the rail 200, through a range of motion which is approximately equal to twice the radial distance between the axis A and either axis D or E. This generally horizontal range of motion is greater than the crank diameter defined between the axes B and C. In other words, the present invention facilitates movement of a force receiving member through a path having a horizontal component which is not necessarily related to or limited by the vertical component and/or the crank diameter. As a result, it is a relatively simple matter to design an apparatus with a desired "aspect ratio" for the elliptical path to be traveled by the foot platform. For example, movement of the axes D and E farther from the axis A and/or movement of the axes B and C closer to the axis A will result in a relatively flatter path. Ultimately, the exact size, configuration, and arrangement of the linkage assembly components are a matter of design choice.

In general, the present invention may also be characterized in terms of an exercise apparatus, comprising: a frame designed to rest upon a floor surface; left and right cranks mounted on opposite sides of said frame and rotatable relative thereto about a common crank axis; and left and right linkage assemblies disposed on opposite sides of said frame and including: respective first portions connected to respective cranks at diametrically opposed locations relative to said crank axis, and thereby defining a crank diameter between said locations; respective second portions movably connected to said frame at an end opposite said cranks; and respective foot supports interconnected between respective first portions and respective second portions and movable relative to said frame through a distance greater than said crank diameter.

Another way to characterize the present invention is as an exercise apparatus, comprising: a frame designed to rest upon a floor surface; left and right cranks rotatably mounted on said frame; left and right rails having first ends supported by respective cranks and second ends supported by said frame; and left and right foot supports movably mounted on respective rails and connected to respective cranks in such a manner that rotation of said cranks causes each of said foot supports to move vertically together with a respective rail and horizontally relative to a respective rail.

The present invention may be described in terms of methods, as well. For example, the present invention provides a method of linking rotation of left and right cranks to generally elliptical motion of left and right foot supporting members, comprising the steps of: providing a frame sized and configured to support a person relative to an underlying floor surface; rotatably mounting the left and right cranks on the frame; movably interconnecting left and right rails between the frame and respective cranks; and movably mounting left and right foot supports on respective rails and connecting the foot supports to respective cranks in such a manner that rotation of the cranks causes each of the foot supports to move vertically together with a respective rail and horizontally relative to a respective rail.

Figure 7:
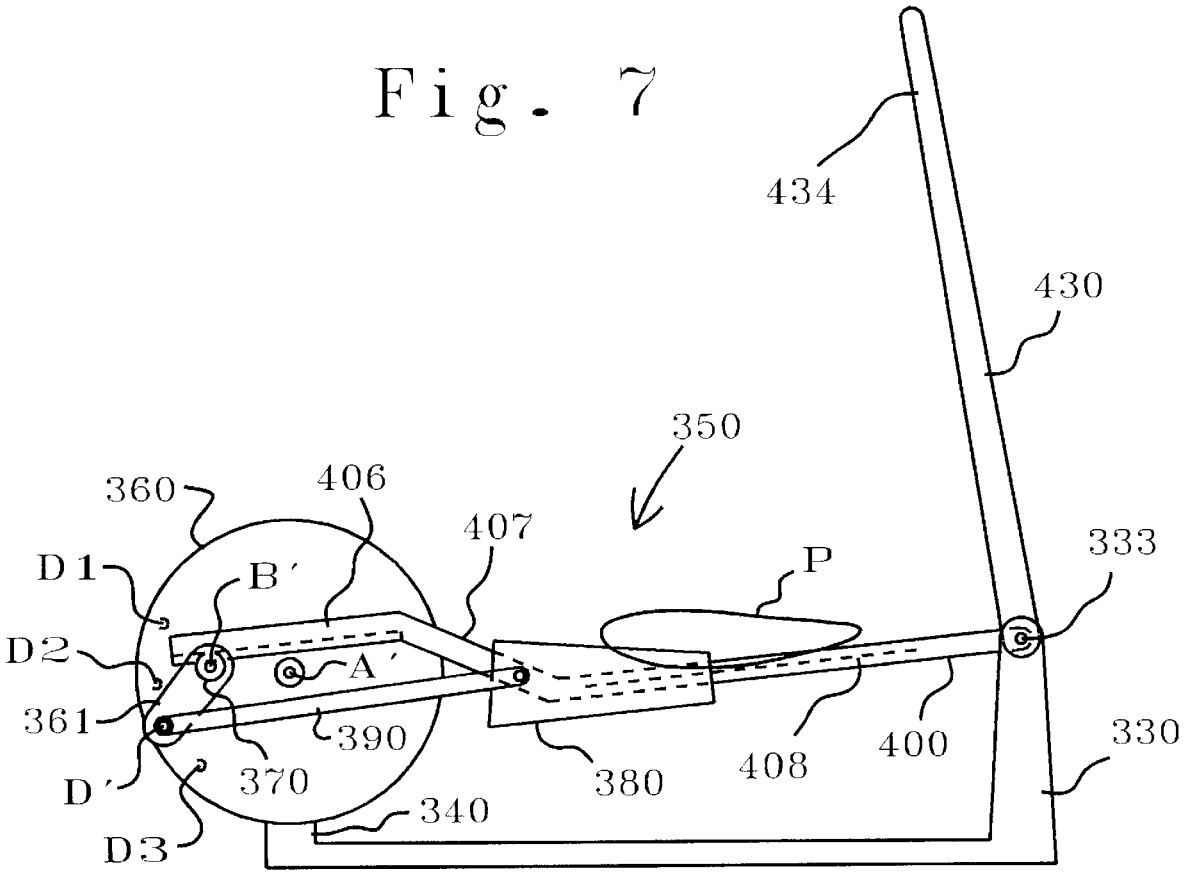
FIG. 7 is a side view of an alternative embodiment exercise apparatus constructed according to the principles of the present invention.

The spatial relationships, including the radii and angular displacement of the crank axes, may vary for different sizes, configurations, and arrangements of the linkage assembly components. For example, another embodiment of the present invention is shown in FIG. 7. The exercise apparatus 300 includes a linkage assembly 350 which is movably mounted on a frame 320 and includes a handle member 430.

Like on the first apparatus 100, a flywheel 360 is rotatably connected to a rearward stanchion 340 on the frame 320 and rotates about an axis A'; and a roller 370 is rotatably connected to the flywheel 360 and rotates about an axis B', which is radially offset from the axis A'. A rigid member 361 extends from a first end connected to the flywheel 360, proximate axis B', to a second end which is radially offset and circumferentially displaced from the axis B'. A link 390 has a rearward end rotatably connected to the distal end of the member 361. The link 390 rotates about an axis D' relative to the member 361. Simply by varying the size, configuration, and/or orientation of the member 361 and/or the link 390, any of various rotational link axes (D1–D3, for example) may be provided in place of the axis D.

An opposite, forward end of the link 390 is rotatably connected to a force receiving member 380 that rolls along an intermediate portion 408 of a rail 400. A rearward end 406 of the rail 400 is supported on the roller 370. On this embodiment 300, a discrete segment 407 separates or offsets the rearward end 406 and the intermediate portion 408.

A forward end of the rail 400 is pivotally connected to a forward stanchion 330 on the frame 320 by means of a shaft 333. The handle member 430 is also pivotally connected to the forward stanchion 330 by means of the same shaft 333. As a result, the handle member 430 and the rail 400 independently pivot about a common pivot axis. The handle member 430 includes an upper, distal portion 434 which is sized and configured for grasping by a person standing on the force receiving member 380. In operation, the alternative embodiment 300 allows a person to selectively perform arm exercise (by pivoting the handle 430 back and forth), while also performing leg exercise (by driving the force receiving member 380 through the path of motion P associated with the approximate center of the foot supporting surface).

Figure 8:
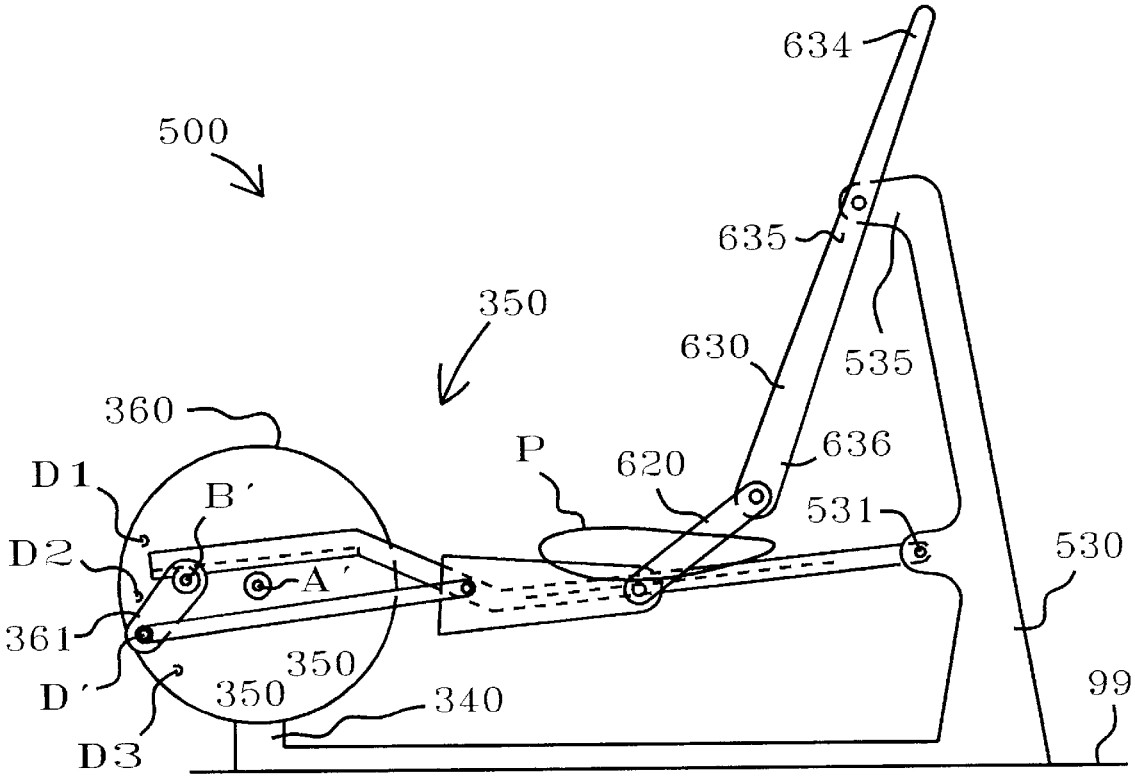
FIG. 8 is a side view of another alternative embodiment exercise apparatus constructed according to the principles of the present invention.

Yet another embodiment of the present invention is designated as 500 in FIG. 8. The exercise apparatus 500 includes a linkage assembly 350 (identical to that of the alternative embodiment 300) movably mounted on a frame 520 and linked to a handle member 630, which is also movably mounted on the frame 520.

A forward end of the rail 400 is pivotally connected to a first trunnion 531 on a forward stanchion 530, at a first elevation above a floor surface 99. A handle member 630 has an intermediate portion 635 which is pivotally connected to a second trunnion 535 on the forward stanchion 530, at a second, relatively greater elevation above the floor surface 99. An upper, distal portion 634 of the handle member 630 is sized and configured for grasping by a person standing on the force receiving member 380. A lower, distal portion 636 of the handle member 630 is rotatably connected to one end of a handle link 620. An opposite end of the handle link 620 is rotatably connected to the force receiving member 380. In operation, the handle link 620 links back and forth pivoting of the handle 430 to movement of the force receiving member 380 through the path of motion P.

Figure 9:
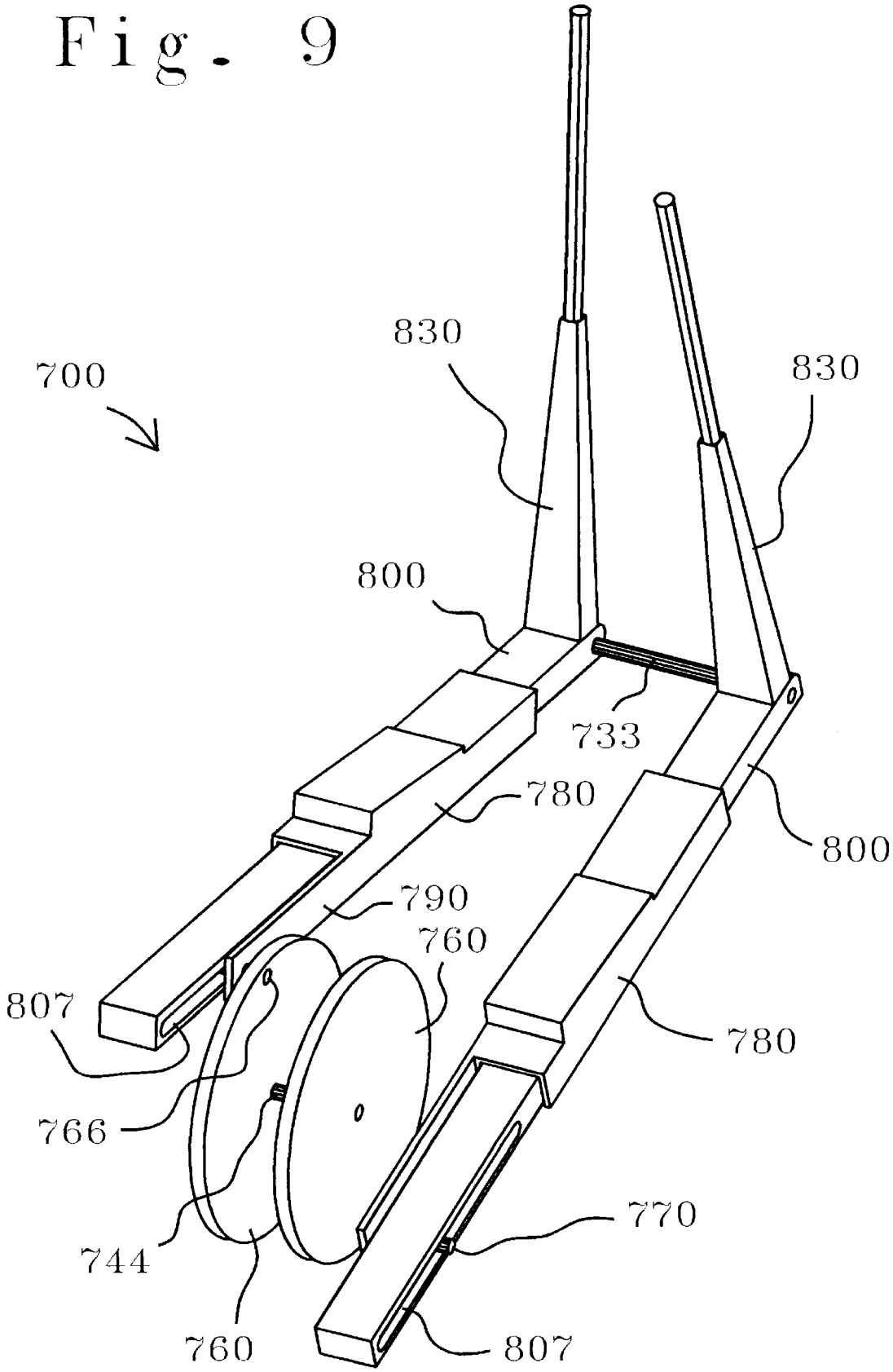
FIG. 9 is a perspective view of yet another alternative embodiment exercise apparatus constructed according to the principles of the present invention.

An alternative embodiment linkage assembly, constructed according to the principles of the present invention, is designated as 700 in FIG. 9. The assembly 700 is movably connected to a frame by means of a forward shaft 733 and a rearward shaft 744. Flywheels 760 are rotatably mounted on the shaft 744 and rotate relative to the frame. A rigid shaft 766 extends axially outward from a radially displaced point on each flywheel 760. Each shaft 766 extends through a hole in a link 790 to a distal end which supports a roller 770. Each roller 770 is disposed within a race or slot 807 formed in the rearward end of a rail 800. The forward end of each rail 800 is pivotally mounted on the shaft 733. In response to rotation of the flywheel 760, the rail 800 rolls back and forth across the roller 770 as the latter causes the former to pivot up and down about the shaft 733. The lower wall of the slot 807 limits upward travel of the rail 800 away from the roller 770.

A handle member 830 is rigidly mounted to the forward end of each rail 800 to pivot together therewith. Alternatively, handle members could be pivotally mounted on the shaft 733, between the rails 800, for example, to pivot independently of the rails 800.

Each link 790 extends forward and integrally joins a respective force receiving member 780 which is rollably mounted on a respective rail 800. In response to rotation of the flywheel 760, the shaft 766 drives the link 790 and the force receiving member 780 back and forth along the rail 800.

Figure 10:
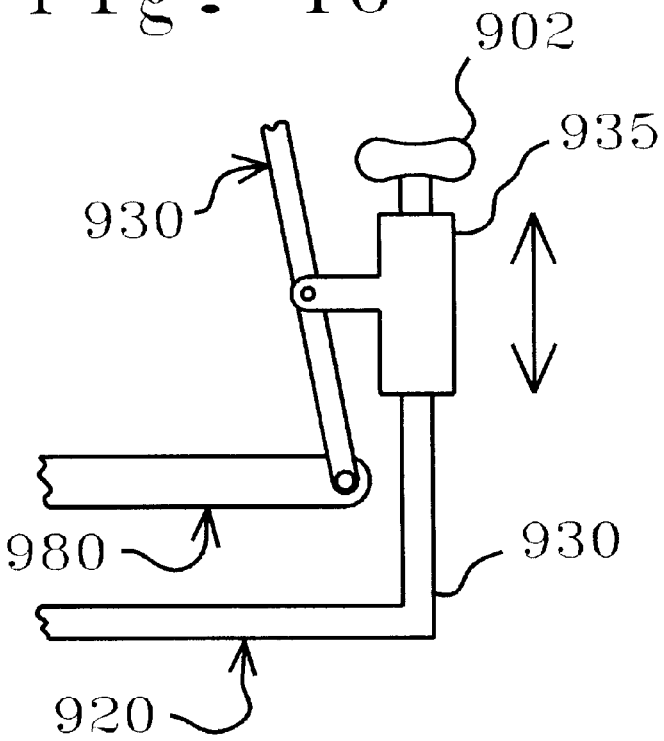
FIG. 10 is a diagrammatic side view of an elevation adjustment mechanism suitable for use on exercise apparatus constructed according to the present invention.

An alternative height adjustment mechanism (in lieu of the ball detent pins and selectively aligned holes described above) is shown diagrammatically in FIG. 10. As with the foregoing embodiments, a frame 920 includes a support 935 movable along an upwardly extending stanchion 930, and a pivoting member 930 is rotatably interconnected between the support 935 and a force receiving member 980. A knob 902 is rigidly secured to a lead screw which extends through the support 935 and threads into the stanchion 930. The knob 902 and the support 935 are interconnected in such a manner that the knob 902 rotates relative to the support 935, but they travel up and down together relative to the stanchion 930 (as indicated by the arrows) when the knob 902 is rotated relative to the stanchion 930.

Figure 11:
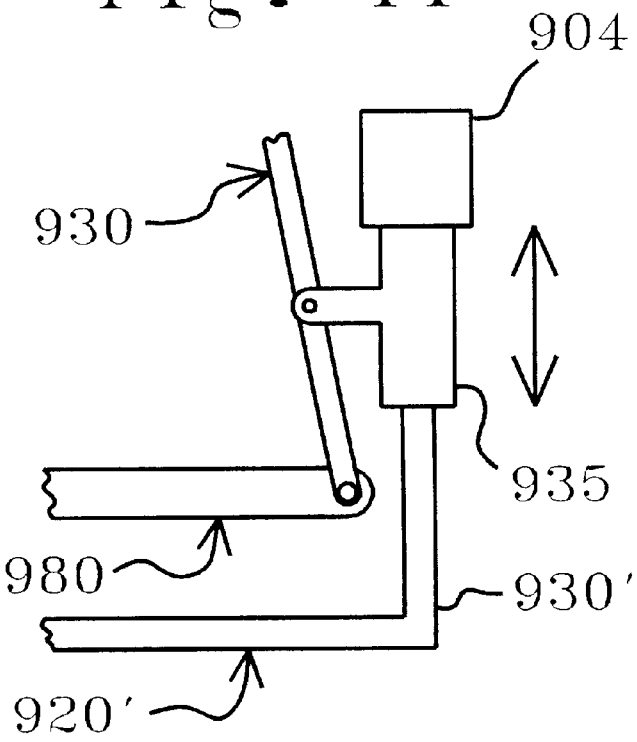
FIG. 11 is a diagrammatic side view of another elevation adjustment mechanism suitable for use on exercise apparatus constructed according to the present invention.
Figure 12:
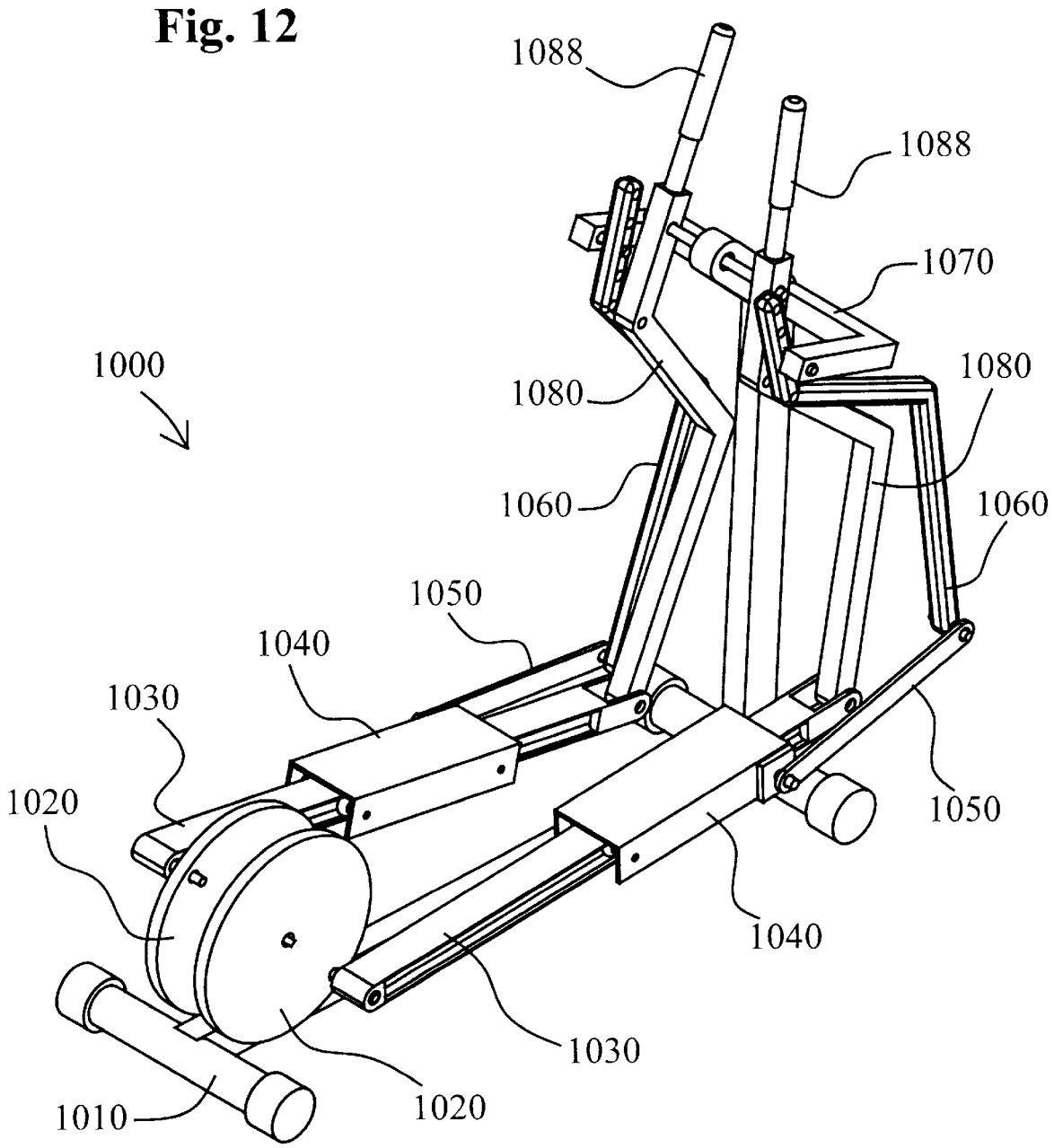
FIG. 12 is a perspective view of another exercise apparatus constructed according to the principles of the present invention.
Figure 13:
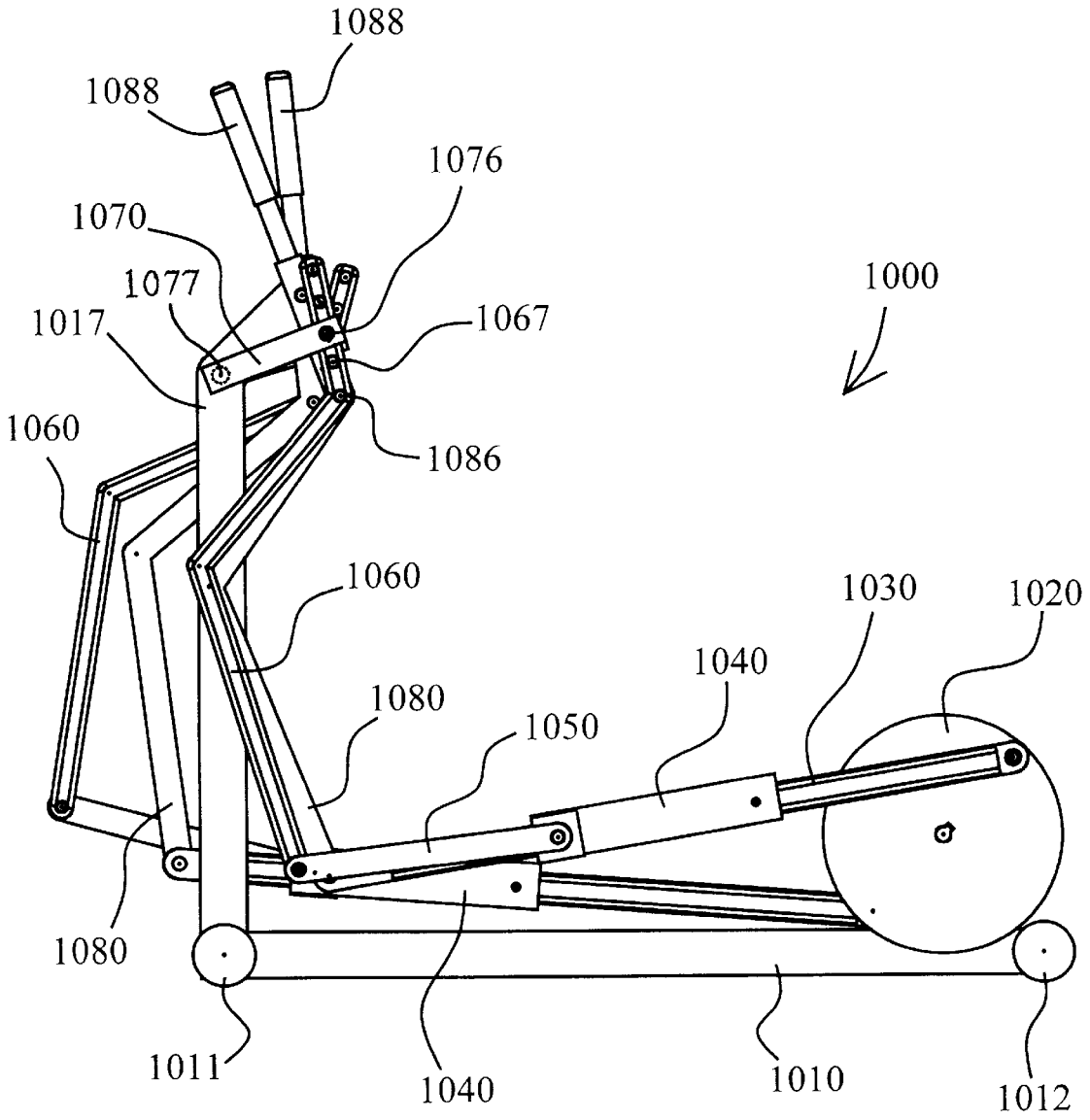
FIG. 13 is a side view of the exercise apparatus of FIG. 12.
Figure 14:
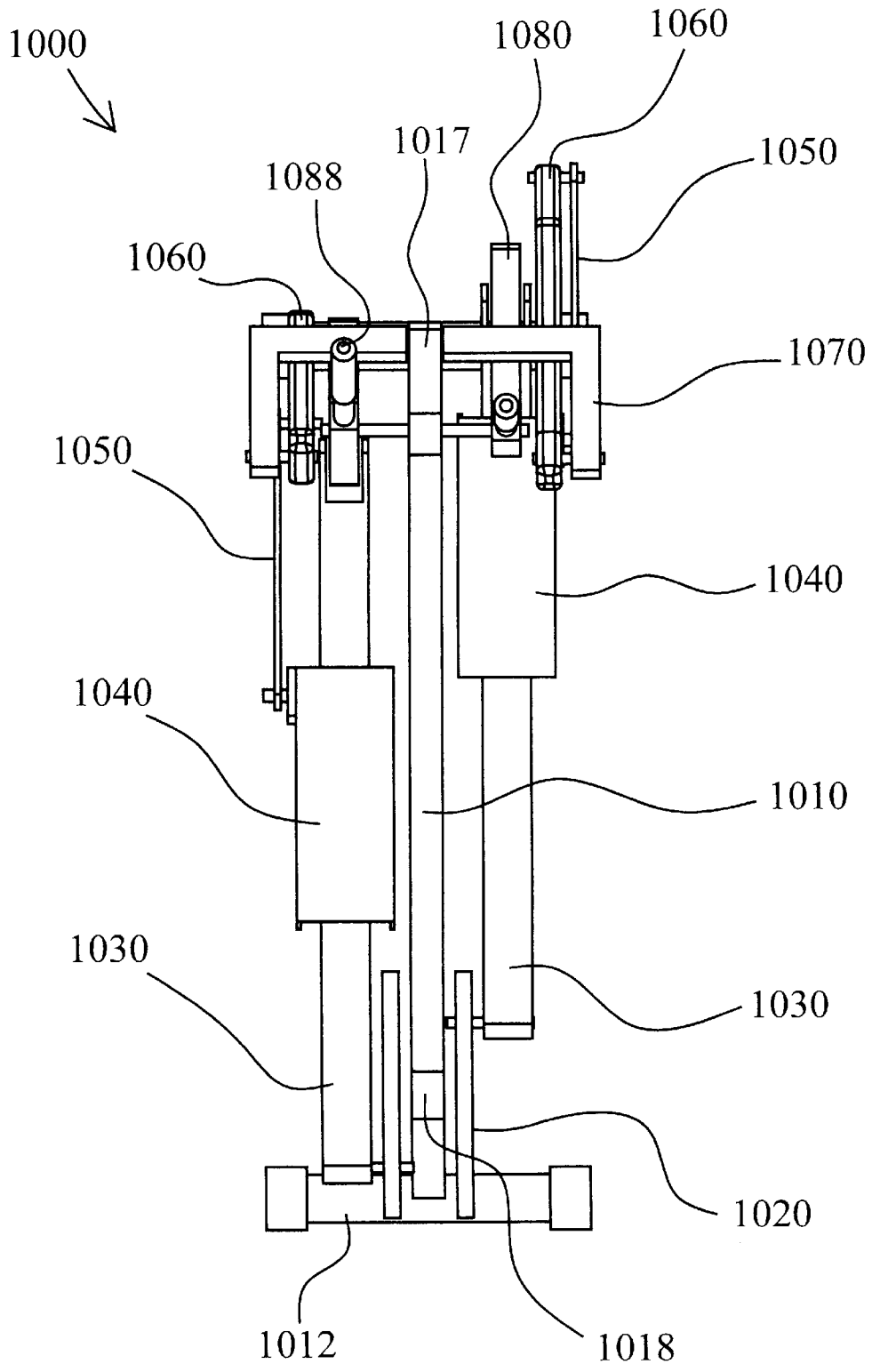
FIG. 14 is a top view of the exercise apparatus of FIG. 12.
Figure 15:
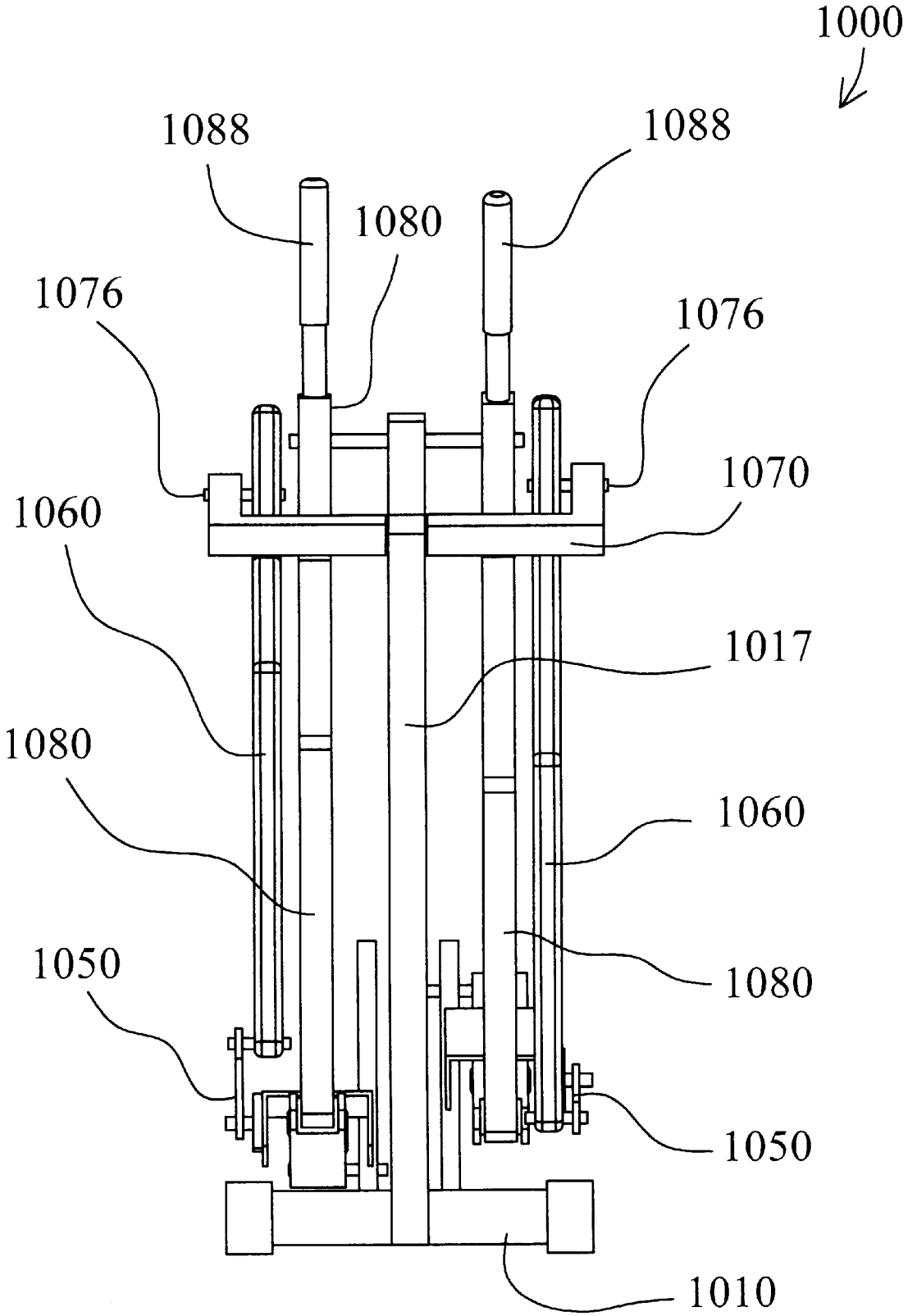
FIG. 15 is a front end view of the exercise apparatus of FIG. 12.
Figure 19:
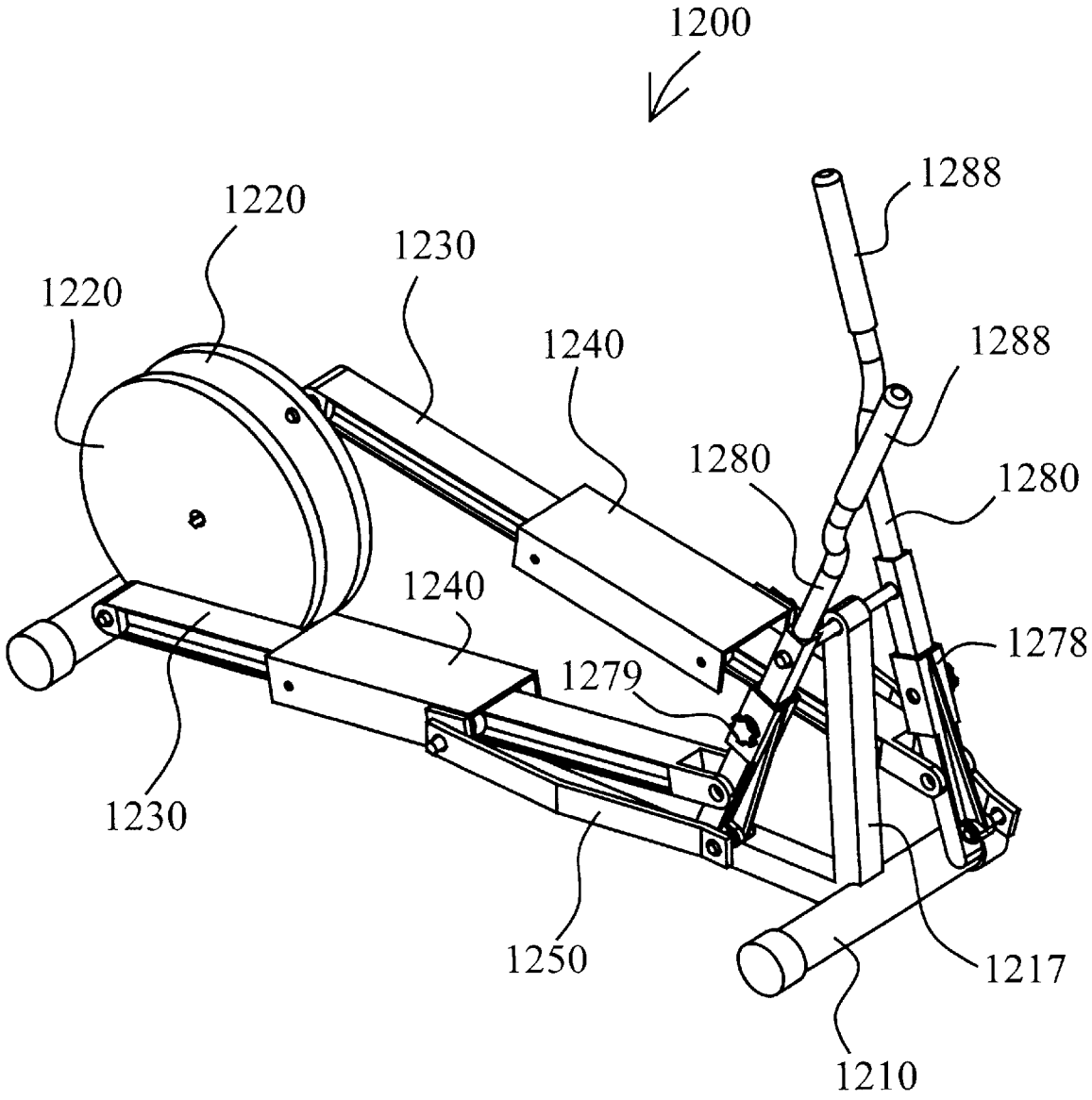
FIG. 19 is a perspective view of another exercise apparatus constructed according to the principles of the present invention.
Figure 20:
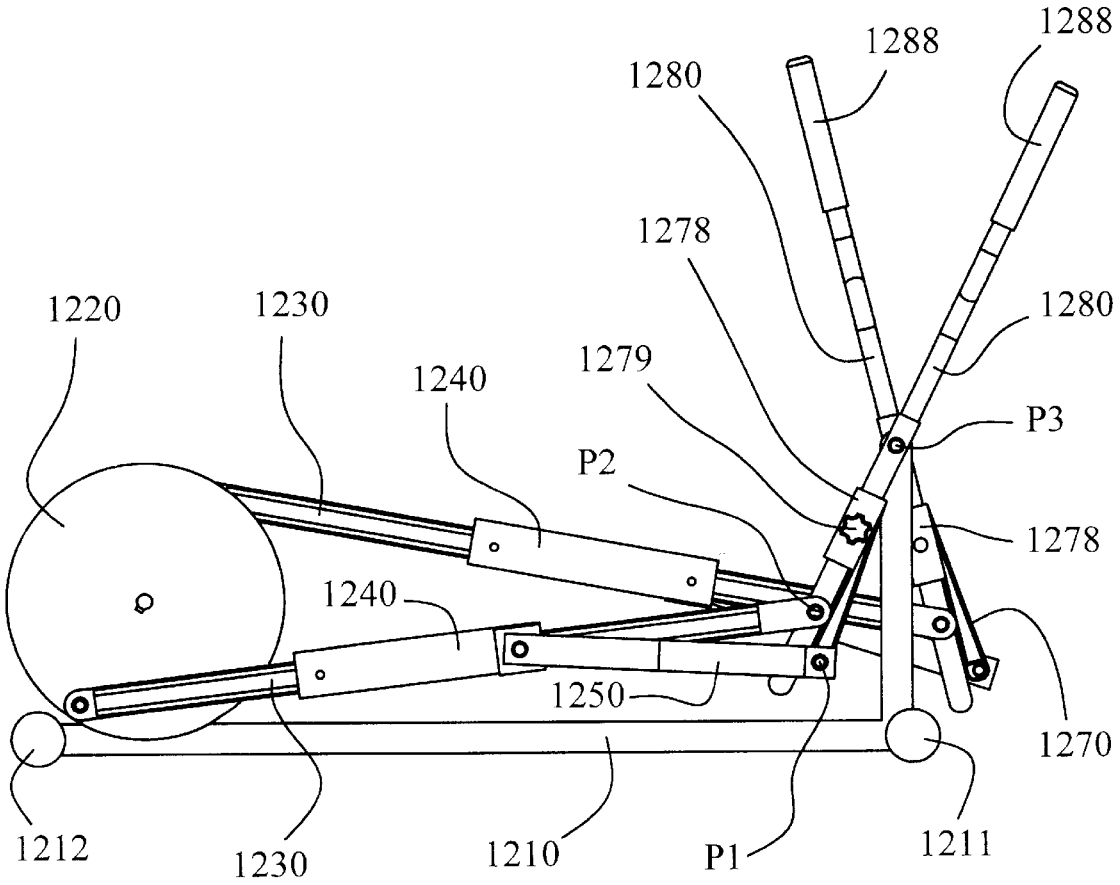
FIG. 20 is a side view of the exercise apparatus of FIG. 19.
Figure 21:
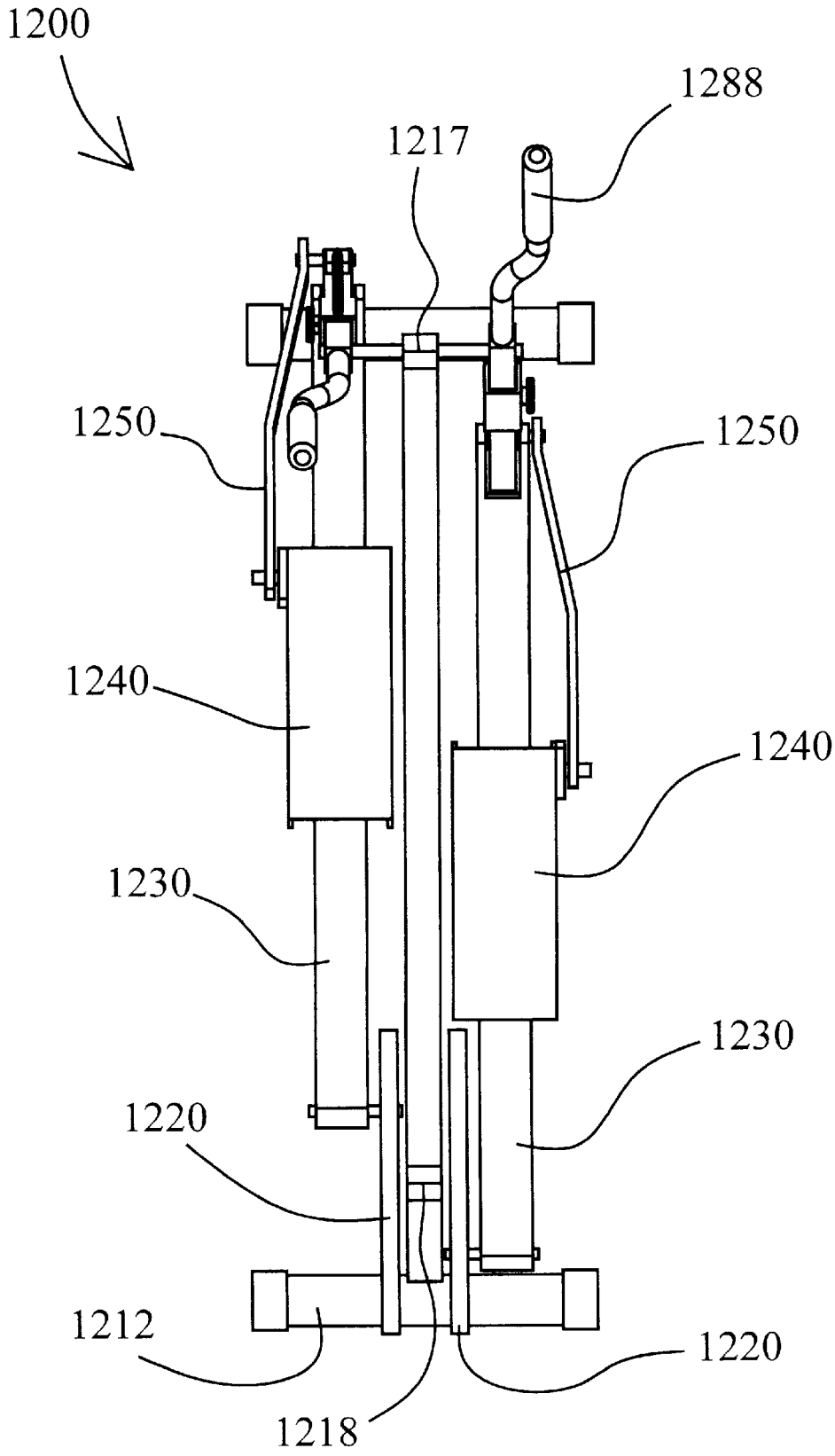
FIG. 21 is a top view of the exercise apparatus of FIG. 19.
Figure 22:
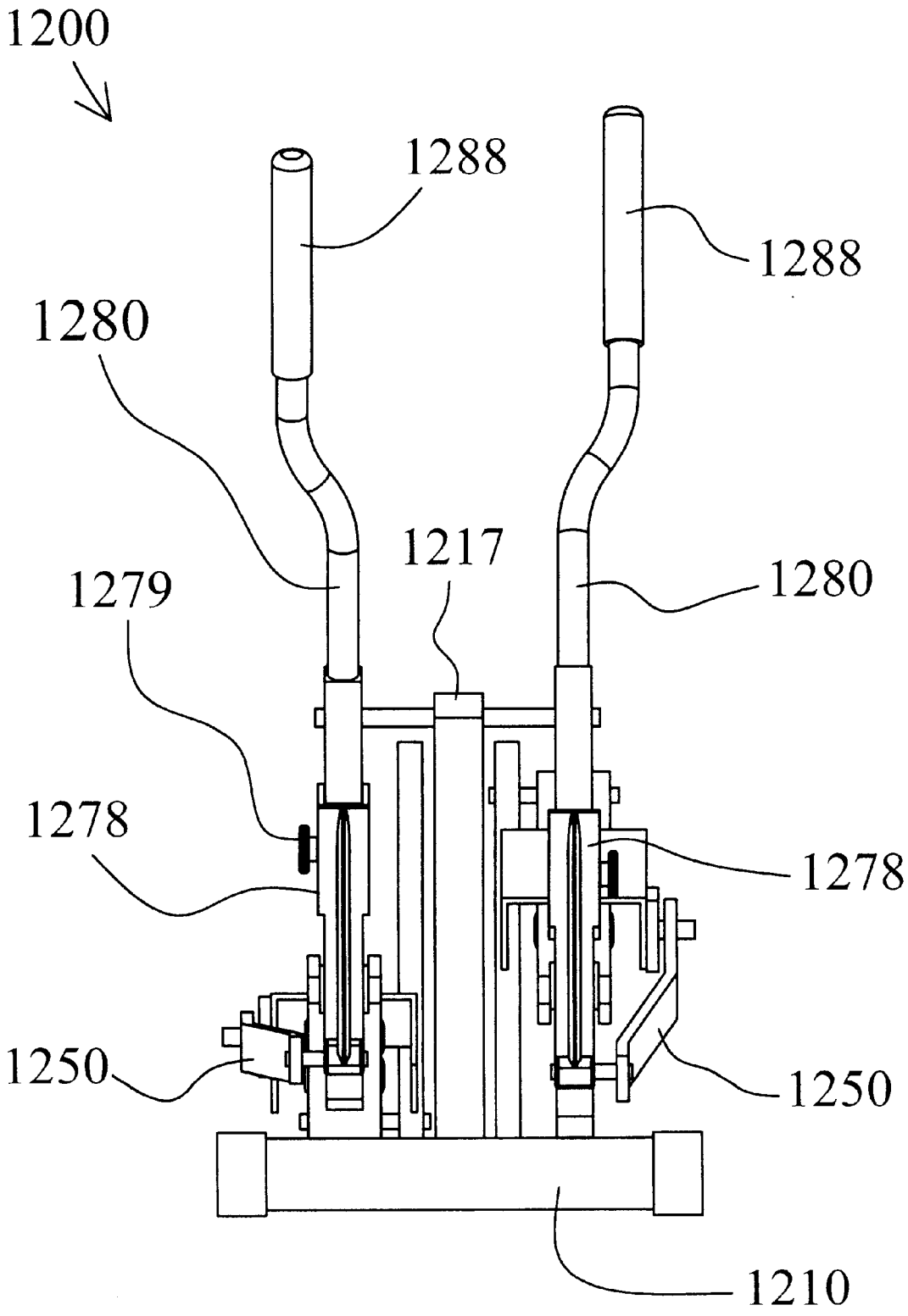
FIG. 22 is a front end view of the exercise apparatus of FIG. 19.
Figure 23:
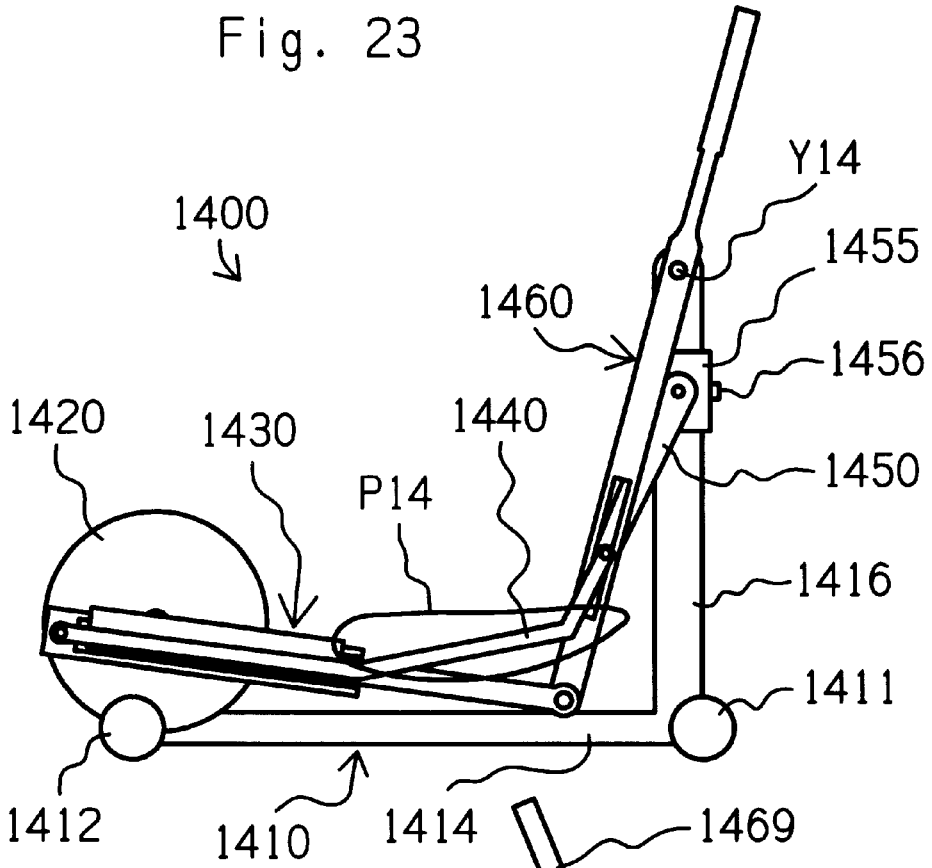
FIG. 23 is a side view of another exercise apparatus constructed according to the principles of the present invention.
Figure 24:
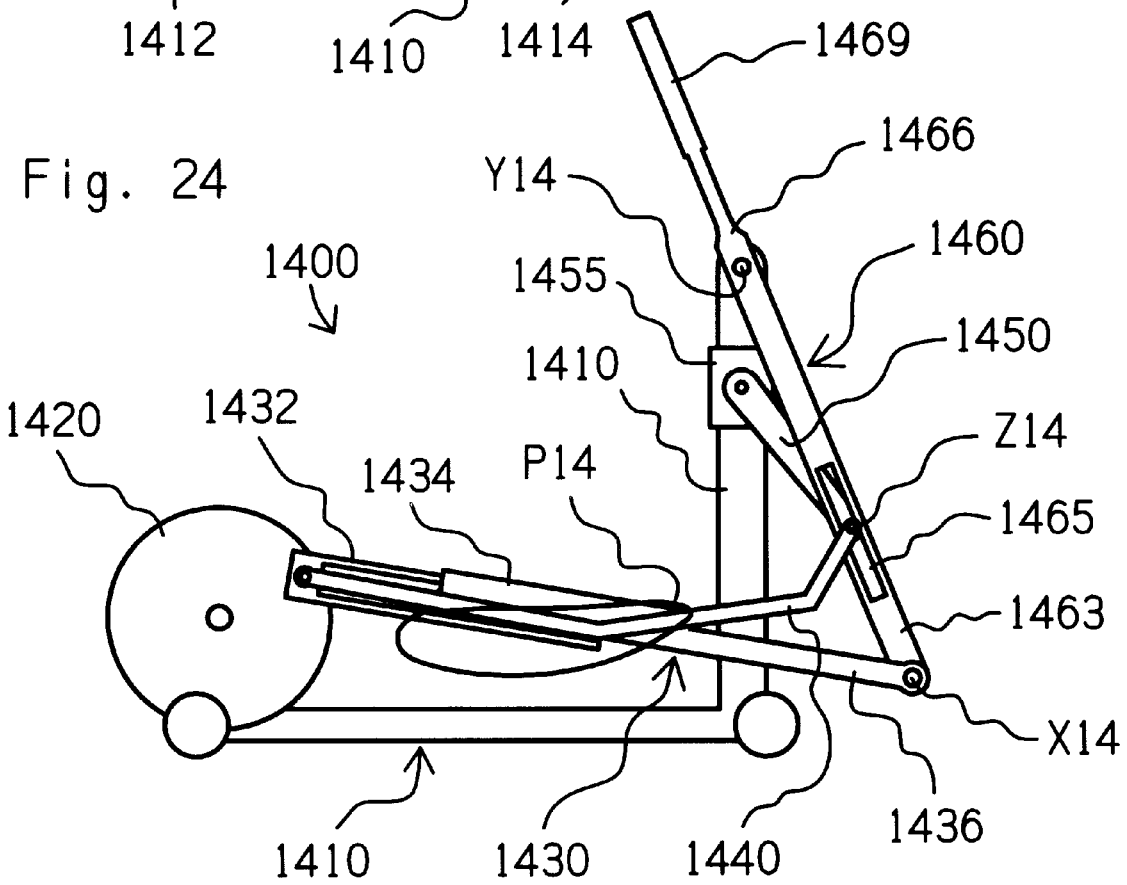
FIG. 24 is a side view of the exercise apparatus of FIG. 23, shown at a discrete point in an exercise cycle.

Yet another suitable height adjustment mechanism is shown diagrammatically in FIG. 11, wherein a frame 920' includes a support 935 movable along an upwardly extending stanchion 930', and a pivoting member 930 is rotatably interconnected between the support 935 and a force receiving member 980. A powered actuator 904, such as a motor or a hydraulic drive, is rigidly secured to the support 935 and connected to a movable shaft which extends through the support 935 and into the stanchion 930'. The actuator 904 selectively moves the shaft relative to the support 935, causing the actuator 904 and the support 935 to travel up and down together relative to the stanchion 930' (as indicated by the arrows). The actuator 904 may operate in response to signals from a person and/or a computer controller.

Another embodiment of the present invention is designated as 1000 in FIGS. 12–15. Since many of the general statements and proposed variations regarding other embodiments are applicable to the apparatus 1000, as well, the following description will focus primarily on the particular linkage assembly being implemented. The apparatus 1000 has a frame 1010 which includes a base designed to rest upon a floor surface; a forward stanchion 1017 extending upward from the base 1010 at its forward end 1011; and a rearward stanchion 1018 extending upward from the base 1010 at its rearward end. Left and right flywheels or cranks 1020 are rotatably mounted on the rearward stanchion 1018 and rotate relative thereto about a crank axis.

Left and right rails or links 1030 have rearward ends which are rotatably connected to radially displaced portions of respective cranks 1020. The resulting axes of rotation are disposed at a crank radius from the crank axis. Forward ends of the rails 1030 are constrained to move in reciprocal fashion relative to the frame 1010. Left and right foot supports or skates 1040 are movably mounted on intermediate portions of respective rails 1030. Each skate 1040 is sized and configured to support one foot of a standing person. On the embodiment 1000, opposing pairs of rollers are rotatably mounted on the skates 1040 and rollable along outwardly opening channels on the rails 1030.

Left and right drawbars or links 1050 have rearward ends rotatably connected to respective skates 1040; and forward ends rotatably connected to lower ends of respective rocker links 1060. Opposite, upper ends of the rocker links 1060 are rotatably connected to respective rocker links 1070 at pin joints 1076. The rocker links 1070 pivot about a common axis 1077 (see FIG. 13) relative to the forward stanchion 1017. Multiple holes 1067 are provided in the rocker links 1060 to adjust the locations of the pin joints 1076 along the upper end of the rocker links 1060.

Intermediate portions of the rocker links 1060, disposed just below the upper ends, are rotatably connected to intermediate portions of respective rocker links 1080 at pin joints 1086. The rocker links 1060 may be described as intermediate rocker links because they are disposed and interconnected between the rocker link 1070 and the rocker links 1080. Relatively higher intermediate portions of the rocker links 1080 are rotatably connected to the forward stanchion 1017. Upper distal ends 1088 of the rocker links 1080 are sized and configured for grasping; and lower ends of the rocker links 1080 are rotatably connected to forward ends of respective rails 1030.

The resulting linkage assembly links rotation of the cranks 1020 to generally elliptical motion of the skates 1040. The skates 1040 move vertically together with the rails 1030 and horizontally relative to the rails 1030. With regard to horizontal movement, the cranks 1020 cause the handle bar rockers 1080 to pivot relative to the frame 1010. Since the intermediate rockers 1060 do not share a frame based pivot axis with the handle bar rockers 1080, they pivot relative to the handle bar rockers 1080 and thereby move the skates 1040 relative to the rails 1030. The amount of relative horizontal movement may be adjusted by changing the locations of the pin joints 1076, which are constrained to move in reciprocal fashion relative to both the frame 1010 and the pin joints 1086.

Other reciprocal motion constraints may be substituted for those shown without departing from the scope of the present invention. For example, in one alternative embodiment, slots are provided in the upper ends of the intermediate rocker links to accommodate pins extending from opposite ends of a support configured like the single rocker link 1070. During steady state operation, the support remains rigid relative to the stanchion 1017, and the pins bear against the walls of the slots. The support is selectively rotatable relative to the stanchion 1017 for purposes of adjusting the amount of horizontal movement between the skates 1040 and the rails 1030.

Another embodiment of the present invention is designated as 1100 in FIGS. 16–17. The apparatus 1100 is similar in many respects to the previous embodiment 1000 and thus, the following description will focus primarily on the linkage distinctions.

Left and right cranks 1120 are rotatably mounted on opposite sides of the frame 1110 proximate the rear end thereof, and a stanchion 1117 extends upward from the frame 1110 proximate the front end thereof. Left and right rails 1130 have rear ends rotatably mounted to radially displaced portions of respective cranks 1120; and front ends rotatably connected to lower ends of respective handle bar links 1180. Left and right foot skates 1140 have rear ends movably mounted on intermediate portions of respective rails 1130; and front ends rotatably connected to lower ends of respective rocker links 1160. Opposite, upper ends of the rocker links 1160 are rotatably connected to the forward stanchion 1117; and intermediate portions of the rocker links 1160, proximate the upper ends thereof, are rotatably connected to intermediate portions of the handle bar links 1180 by pin joints 1187.

Upper distal ends 1188 of the handle bar links 1180 are sized and configured for grasping. Upper portions of the handle bar links 1180, disposed between the upper ends 1188 and the pin joints 1187, are rotatably connected to respective rocker links 1170 which, in turn, are rotatably connected to the forward stanchion 1117. The rocker links 1160 are constrained to move in reciprocal fashion relative to both the frame 1110 and respective handle bar links 1180. As a result of this arrangement, the rails 1130 and the links 1160, 1170, and 1180 cooperate to link rotation of respective cranks 1120 to generally elliptical motion of respective foot skates 1140.

Yet another reciprocal motion constraint is designated as 1100' in FIG. 18. The rocker links 1160 are rotatably connected to stanchion 1117', which has been modified to provide multiple points of connection for left and right supports 1175. The supports 1175 provide bearing members 1177 which are disposed within slots 1178 formed in the upper portions of the handle bar links 1180, between the handle ends 1188 and the pin joints 1187. During steady state operation, the supports 1175 remain rigid relative to the stanchion 1117', and the pins 1177 bear against the walls of the slots 1178. The supports 1175 may be selectively repositioned relative to the stanchion 1117' for purposes of adjusting the configuration of the path traversed by the foot skates 1140.

The foregoing embodiments designated as 1000 and 1100 may be modified in other ways, as well. For example, handles may be disposed on upper ends of the links 1060 or 1160 rather than the upper ends of links 1080 or 1180. Also, the foot supports 1140 may be supported by respective flywheel-mounted rollers rather than rail engaging rollers. Furthermore, adjustments to the supports 1175 on the embodiment designated as 1100' may be effected manually or by a powered actuator which selectively moves the supports along the forward stanchion.

Another embodiment of the present invention is designated as 1200 in FIGS. 19–22. Many of the general statements and proposed variations made with reference to other embodiments are applicable to the apparatus 1200, as well. Therefore, the following description will focus primarily on the particular linkage assembly being implemented. The apparatus 1200 has a frame 1210 which includes a base designed to rest upon a floor surface; a forward stanchion 1217 extending upward from the base 1210 proximate its forward end 1211; and a rearward stanchion 1218 extending upward from the base 1210 proximate its rearward end. Left and right flywheels or cranks 1220 are rotatably mounted on the rearward stanchion 1218 and rotate relative thereto about a crank axis.

Left and right rails or links 1230 have rearward ends which are rotatably connected to radially displaced portions of respective cranks 1220. The resulting axes of rotation are disposed at a crank radius from the crank axis. Forward ends of the rails 1230 are constrained to move in reciprocal fashion relative to the frame 1210. Left and right foot supports or skates 1240 are movably mounted on intermediate portions of respective rails 1230. Each skate 1240 is sized and configured to support one foot of a standing person. On the embodiment 1200, opposing pairs of rollers are rotatably mounted on the skates 1240 and rollable along channels on the rails 1230.

Left and right drawbars or links 1250 have rearward ends rotatably connected to respective skates 1240. Forward ends of the drawbars 1250 are rotatably connected to lower ends of respective support members 1270 and thereby define pivot axes P1. Opposite, upper ends of the support members 1270 are rigidly secured to respective bushings 1278. The bushings 1278 are selectively movable along lower portions of respective rocker links 1280 and secured in place relative thereto by respective knob and bolt assemblies 1279.

A lower portion of each rocker link 1280 is rotatably connected to the forward end of a respective rail 1230, as well, thereby defining respective pivot axes P2. An intermediate portion of each rocker link 1280 is rotatably connected to the forward stanchion 1217, thereby defining a pivot axis P3. An upper end of each rocker link 1280 is sized and configured for grasping.

The resulting linkage assembly links rotation of the cranks 1220 to generally elliptical motion of the skates 1240. The pivot axes P1 move through arcs at a first radius from the pivot joint P3, and the pivot axes P2 move through arcs at a second radius from the pivot joint P3. When the first radius is equal to the second radius, there is essentially no relative motion between the foot skates 1240 and the rails 1230. When the first radius is greater than the second radius, the foot skates 1240 travel through a larger range of horizontal motion than the rails 1230. When a longer stride is desired, the pivot axes P1 are adjusted downward relative to the rocker links 1280, and conversely, when a shorter stride is desired, the pivot axes P1 are adjusted upward relative to the rocker links 1280.

Another embodiment of the present invention is designated as 1400 in FIGS. 23–26. Since many of the general statements and proposed variations regarding other embodiments of the present invention are applicable to the apparatus 1400, as well, the following description will focus primarily on the particular linkage assembly being implemented. The apparatus 1400 has a frame 1410 which includes a base 1414 designed to rest upon a floor surface; a forward stanchion 1416 extending upward from the base 1414 at its forward end 1411; and a rearward stanchion extending upward from the base 1414 at its rearward end 1412. Left and right flywheels or cranks 1420 are rotatably mounted on the rearward stanchion and rotate relative thereto about a crank axis.

On each side of the apparatus 1400, a rearward member 1432 and a forward member 1436 cooperate to define a telescoping member or foot supporting link 1430. Each rearward member 1432 is connected to a respective forward member 1436 by means known in the art (such as rollers, for example). A rearward end of each rearward member 1432 is rotatably connected to a radially displaced portion of a respective crank 1420. The resulting axes of rotation are disposed at a crank radius from the crank axis.

A foot platform 1434 is disposed on the rearward end of each forward member 1436. Each foot platform 1434 is sized and configured to support one foot of a standing person. A forward end of each forward member 1436 is constrained to move in reciprocal fashion relative to the frame 1410. In particular, a forward end of each forward member 1436 is rotatably connected to a lower end 1463 of a respective handlebar or rocker link 1460, thereby defining a pivot axis X14. An intermediate portion 1466 of each handlebar 1460 is rotatably connected to an upper end of the stanchion 1416, thereby defining a pivot axis Y14. An upper end 1469 of each handlebar 1460 is sized and configured for grasping by a person standing on the foot platforms 1434.

On each side of the apparatus 1400, a drawbar link 1440 has a rearward end which is rotatably connected to a radially displaced portion of a respective crank 1420. On this embodiment 1400, respective drawbar links 1440 and foot supporting links 1430 share common pivot axes relative to their respective cranks 1420, but the invention is not limited in this regard.

A forward end of each drawbar link 1440 is constrained to move in reciprocal fashion relative to the frame 1410. In particular, a forward end of each drawbar link 1440 is rotatably connected to a lower end of a respective rocker link 1450, thereby defining a pivot axis Z14. An opposite, upper end of each rocker link 1450 is rotatably connected to an intermediate portion of the stanchion 1416 by means of a bracket or collar 1455. The collar 1455 is movable along the stanchion 1416 and selectively locked in place by means of a fastener 1456 which inserts into any of a plurality of holes in the stanchion 1416.

On each side of the apparatus 1400, the pivot axis Z14 is constrained to move along a slot 1465 in the handlebar 1460. The radius defined between the pivot axis X14 and the pivot axis Y14 is greater than the radius defined between the pivot axis Z14 and the pivot axis Y14. As a result, the pivot axis X14 travels through a longer arc than the pivot axis Z14 during pivoting of the handlebar 1460 relative to the frame 1410, and the foot support 1434 is thereby driven back and forth through a greater range of motion than the drawbar 1440 during rotation of the crank 1420.

Figure 25:
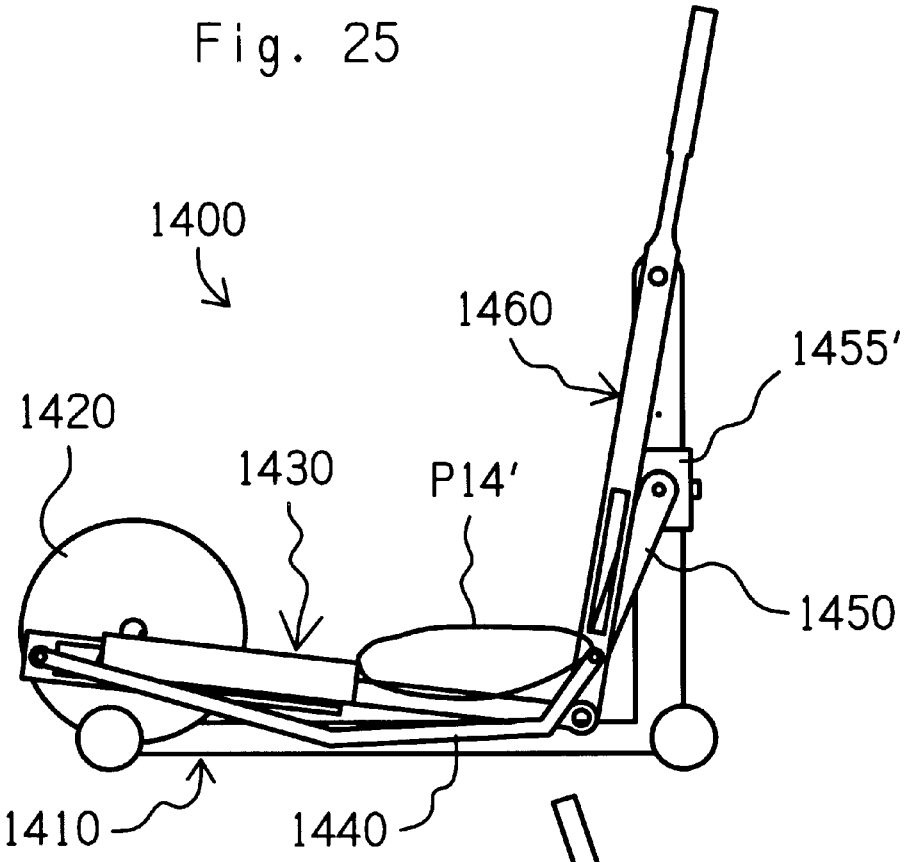
FIG. 25 is a side view of the exercise apparatus of FIG. 23, shown in an alternative configuration which provides a relatively shorter exercise stroke.
Figure 26:
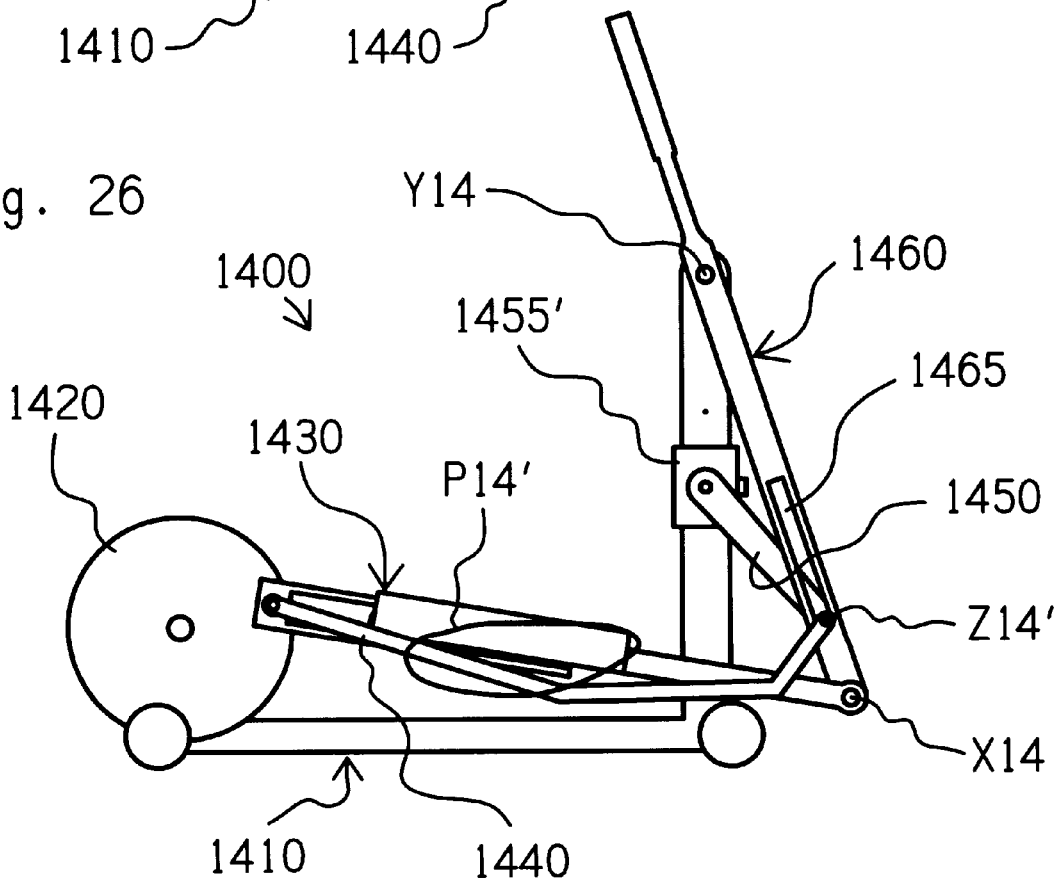
FIG. 26 is a side view of the exercise apparatus of FIG. 25, shown at a discrete point in an exercise cycle.

The resulting linkage assembly links rotation of the cranks 1420 to movement of the foot supports 1434 through generally elliptical paths P14. The foot supports 1440 move vertically together with the rear members 1432 and horizontally relative to the rear members 1432. With regard to horizontal movement, the cranks 1420 cooperate with the drawbars 1440, rockers 1450, and handlebars 1460 to move the foot supports 1434 through a horizontal range of motion which is greater than twice the crank radius. As shown in FIGS. 25–26, a relative lower collar 1455' moves the pivot axis Z14' relatively closer to the pivot axis X14 and thereby reduces the amplifying effect of the drawbar 1440. In other words, the collar 1455' is moved downward along the stanchion 1416 to provide a relative shorter path P14' of exercise motion.

Several related "stroke amplifying" embodiments are shown in FIGS. 27–30. On each embodiment, left and right drawbar links are pivotally connected to respective rocker links at a first radius, and left and right foot supporting links are pivotally connected to respective rocker links at a second, relatively greater radius. The drawbar links are constrained to move fore and aft through a range of motion equal to twice the crank radius, and the foot supporting links are constrained to move fore and aft through a relatively greater range of motion.

Figure 27:
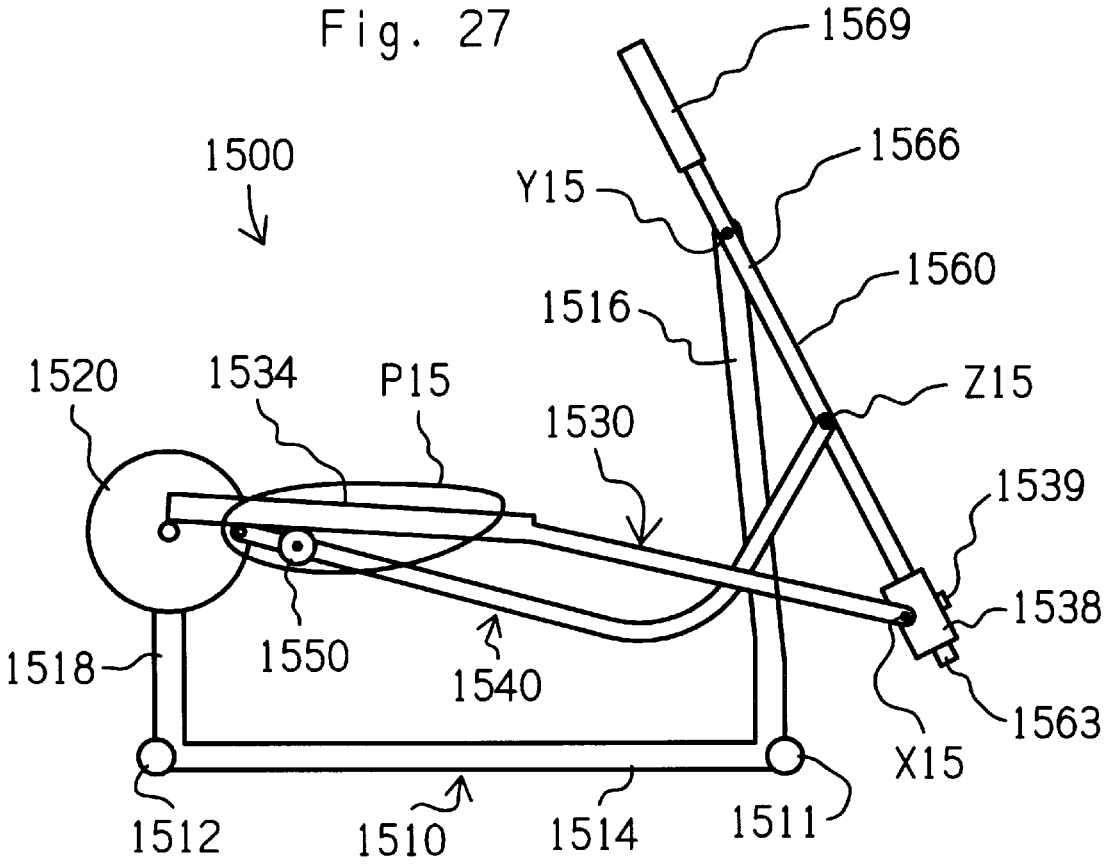
FIG. 27 is a side view of another exercise apparatus constructed according to the principles of the present invention.

FIG. 27 shows an exercise apparatus 1500 having a frame 1510 which includes a base 1514 designed to rest upon a floor surface; a forward stanchion 1516 extending upward from the base 1514 at its forward end 1511; and a rearward stanchion 1518 extending upward from the base 1514 at its rearward end 1512. Left and right flywheels or cranks 1520 are rotatably mounted on the rearward stanchion 1518 and rotate relative thereto about a common crank axis.

On each side of the apparatus 1500, a drawbar link 1540 has a rearward end which is rotatably connected to a radially displaced portion of a respective crank 1520, and a forward end which is rotatably connected to an intermediate portion of a respective handlebar or rocker link 1560. The drawbar links 1540 cooperate with the rocker links 1560 to define respective pivot axes Z15. A relatively higher portion 1566 of each rocker link 1560 is rotatably connected to the forward stanchion 1516 at a common pivot axis Y15. An upper end 1569 of each rocker link 1560 is sized and configured for grasping.

Right and left rollers 1550 are rotatably mounted on relatively rearward portions of respective drawbar links 1540. Right and left foot supporting links 1530 have rearward portions 1534 which are sized and configured to support respective feet of a standing person, and which are supported by respective rollers 1550. The foot supporting links 1530 have forward portions which are rotatably connected to lower ends 1563 of respective rocker links 1560. More specifically, a forward end of each foot supporting link 1530 is rotatably connected to a respective bracket or collar 1538, which in turn, is connected to the lower end 1563 of a respective rocker link 1560. Each collar 1538 is movable along a respective rocker link 1560 and selectively locked in place by means of a fastener 1539 which inserts into any of a plurality of holes in the rocker link 1560. The foot supporting links 1530 cooperate with the rocker links 1560 (via the collars 1538) to define respective pivot axes X15.

When configured as shown in FIG. 27, the apparatus 1500 links rotation of the cranks 1520 to movement of the foot supports 1534 through generally elliptical paths of motion designated as P15. The rocker links 1560 constrain the pivot axes X15 and Z15 to move in arcuate fashion relative to the frame 1510. The arrangement of the pivot axes X15, Y15, and Z15 is such that the major axis of each path P15 is longer than twice the crank radius. The length of the path P15 may be selectively shortened by moving the collars 1538 upward along the rocker links 1560.

Figure 28:
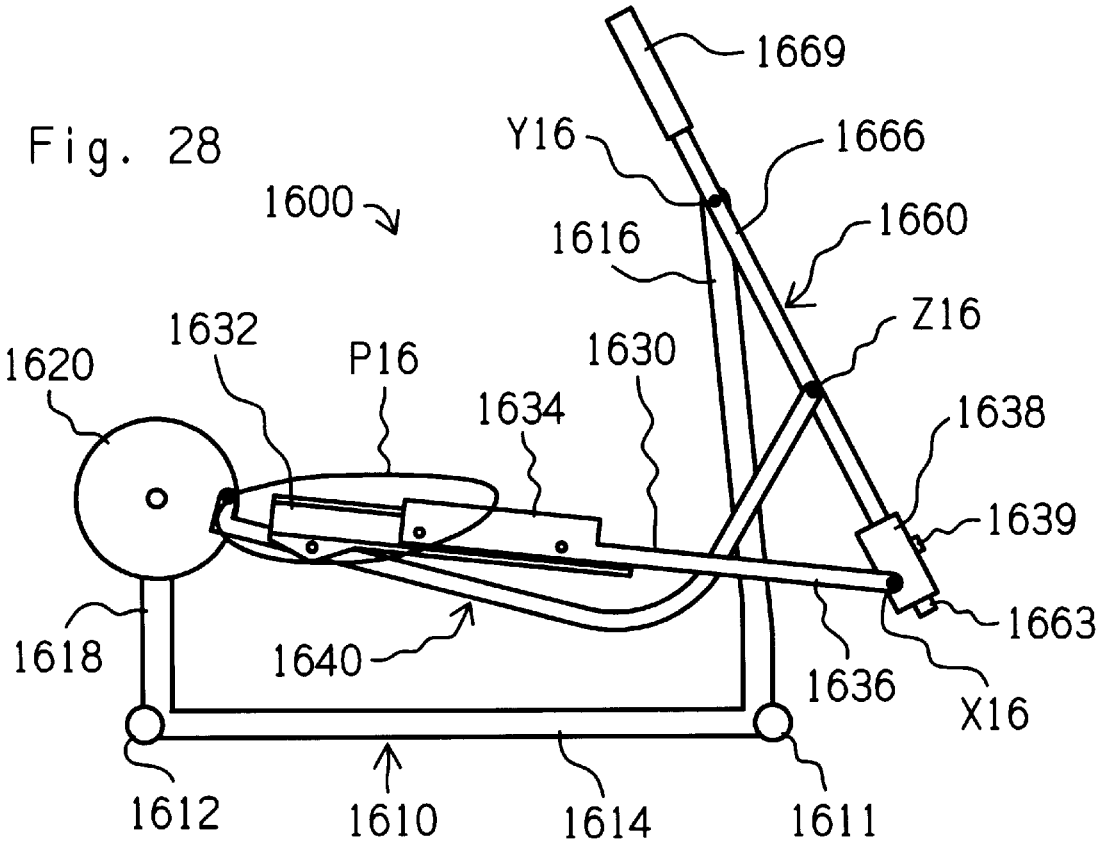
FIG. 28 is a side view of another exercise apparatus constructed according to the principles of the present invention.

FIG. 28 shows an exercise apparatus 1600 having a frame 1610 which includes a base 1614 designed to rest upon a floor surface; a forward stanchion 1616 extending upward from the base 1614 at its forward end 1611; and a rearward stanchion 1618 extending upward from the base 1614 at its rearward end 1612. Left and right flywheels or cranks 1620 are mounted on the rearward stanchion 1618 and rotate relative thereto about a common crank axis.

On each side of the apparatus 1600, a drawbar link 1640 has a rearward end which is rotatably connected to a radially displaced portion of a respective crank 1620, and a forward end which is rotatably connected to an intermediate portion of a respective handlebar or rocker link 1660. The drawbar links 1640 cooperate with the rocker links 1660 to define respective pivot axes Z16. A relatively higher portion 1666 of each rocker link 1660 is rotatably connected to the forward stanchion 1616 at a common pivot axis Y16. An upper end 1669 of each rocker link 1660 is sized and configured for grasping.

On each side of the apparatus 1600, a rearward member 1632 and a forward member 1636 cooperate to define a telescoping member or foot supporting link 1630. Each rearward member 1632 is connected to a respective forward member 1636 by means known in the art (such as rollers, for example). A rearward end of each rearward member 1632 is rotatably connected to a rearward portion of a respective drawbar link 1640. A rearward portion 1634 of each forward member 1636 is sized and configured to support a respective foot of a standing person.

A forward portion of each forward member 1636 is rotatably connected to a lower end 1663 of a resepective rocker link 1660. More specifically, a forward end of each forward member 1636 is rotatably connected to a respective collar 1638, which in turn, is connected to the lower end 1663 of a respective rocker link 1660. Each collar 1638 is movable along a respective rocker link 1660 and selectively locked in place by means of a fastener 1639 which inserts into any of a plurality of holes in the rocker link 1660. The foot supporting links 1630 cooperate with the rocker links 1660 (via the collars 1638) to define respective pivot axes X16.

When configured as shown in FIG. 28, the apparatus 1600 links rotation of the cranks 1620 to movement of the foot supports 1634 through generally elliptical paths of motion designated as P16. The rocker links 1660 constrain the pivot axes X16 and Z16 to move in arcuate fashion relative to the frame 1610. The arrangement of the pivot axes X16, Y16, and Z16 is such that the major axis of each path P16 is longer than twice the crank radius. The length of the path P16 may be selectively shortened by moving the collars 1638 upward along the rocker links 1660.

Figure 29:
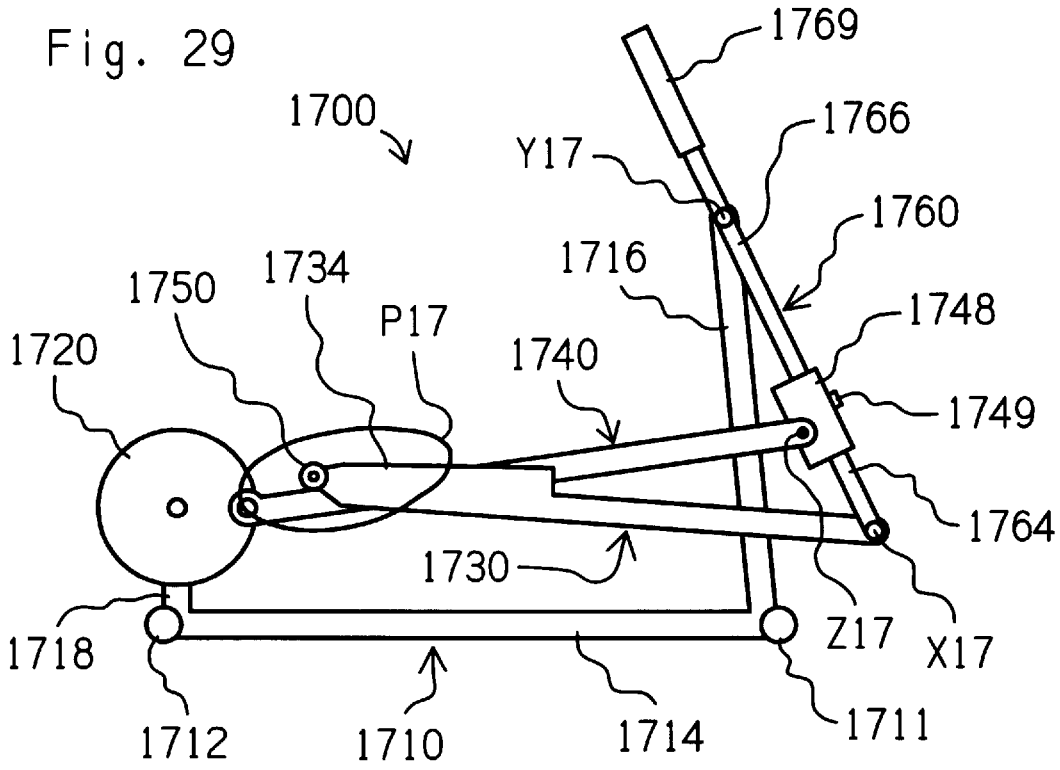
FIG. 29 is a side view of another exercise apparatus constructed according to the principles of the present invention.

FIG. 29 shows an exercise apparatus 1700 having a frame 1710 which includes a base 1714 designed to rest upon a floor surface; a forward stanchion 1716 extending upward from the base 1714 at its forward end 1711; and a rearward stanchion 1718 extending upward from the base 1714 at its rearward end 1712. Left and right flywheels or cranks 1720 are rotatably mounted on the stanchion 1718 and rotate relative thereto about a common crank axis.

On each side of the apparatus 1700, a drawbar link 1740 has a rearward end which is rotatably connected to a radially displaced portion of a respective crank 1720, and a forward end which is rotatably connected to an intermediate portion 1764 of a respective handlebar or rocker link 1760. More specifically, a forward end of each drawbar link 1740 is rotatably connected to a respective bracket or collar 1748, which in turn, is connected to the intermediate portion 1764 of a respective rocker link 1760. Each collar 1748 is movable along a respective rocker link 1760 and selectively locked in place by means of a fastener 1749 which inserts into any of a plurality of holes in the rocker link 1760. The drawbar links 1740 cooperate with the rocker links 1760 (via the collars 1748) to define respective pivot axes Z17.

A relatively higher portion 1766 of each rocker link 1760 is rotatably connected to the forward stanchion 1716 at a common pivot axis Y17. An upper end 1769 of each rocker link 1760 is sized and configured for grasping.

Right and left rollers 1750 are rotatably mounted on rearward ends of respective foot supporting links 1730. The rollers 1750 are supported by rearward portions of respective drawbars 1740. The foot supporting links 1730 have rearward portions 1734 which are sized and configured to support respective feet of a standing person. The foot supporting links 1730 have forward portions which are rotatably connected to lower ends of resepective rocker links 1760. The foot supporting links 1730 cooperate with the rocker links 1760 to define respective pivot axes X17.

When configured as shown in FIG. 29, the apparatus 1700 links rotation of the cranks 1720 to movement of the foot supports 1734 through generally elliptical paths of motion designated as P17. The rocker links 1760 constrain the pivot axes X17 and Z17 to move in arcuate fashion relative to the frame 1710. The arrangement of the pivot axes X17, Y17, and Z17 is such that the major axis of each path P17 is longer than twice the crank radius. The length of the path P17 may be selectively lengthened by moving the collars 1748 upward along the rocker links 1760.

Figure 30:
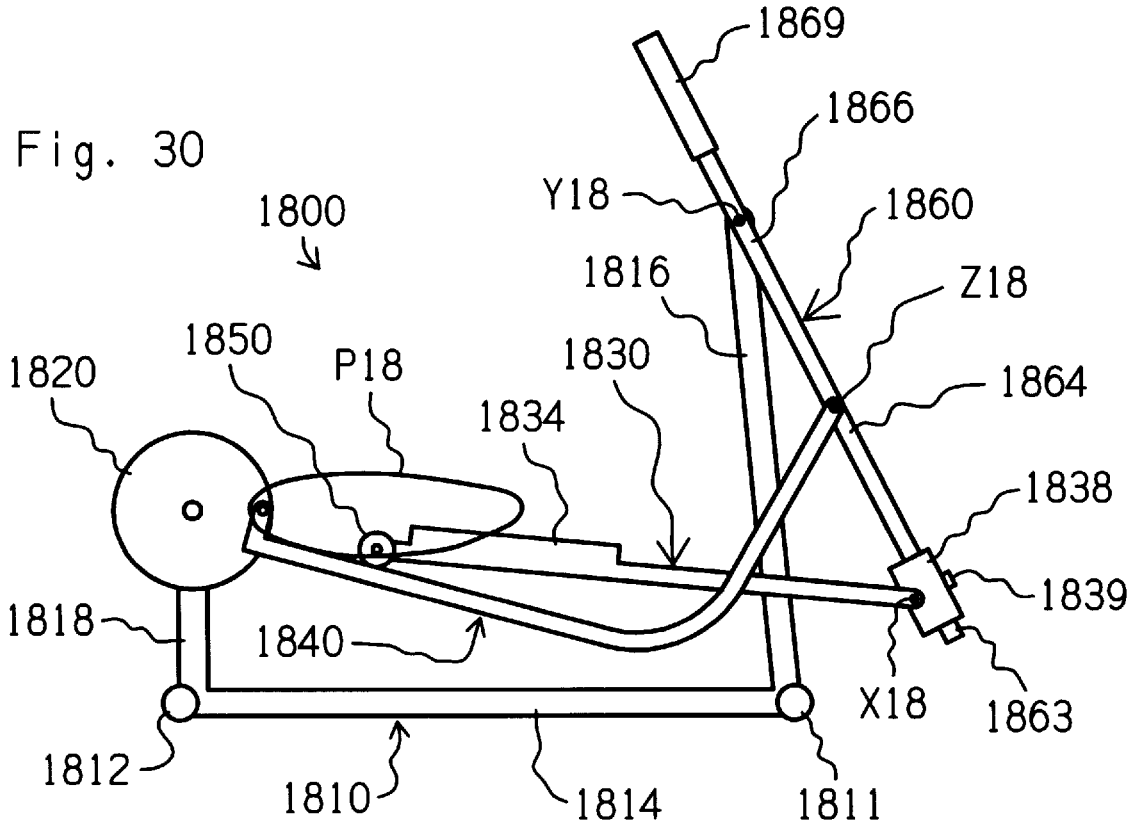
FIG. 30 is a side view of another exercise apparatus constructed according to the principles of the present invention.

FIG. 30 shows an exercise apparatus 1800 having a frame 1810 which includes a base 1814 designed to rest upon a floor surface; a forward stanchion 1816 extending upward from the base 1814 at its forward end 1811; and a rearward stanchion 1818 extending upward from the base 1814 at its rearward end 1812. Left and right flywheels or cranks 1820 are rotatably mounted on the stanchion 1818 and rotate relative thereto about a common crank axis.

On each side of the apparatus 1800, a drawbar link 1840 has a rearward end which is rotatably connected to a radially displaced portion of a respective crank 1820, and a forward end which is rotatably connected to an intermediate portion 1864 of a respective handlebar or rocker link 1860. The drawbar links 1840 cooperate with the rocker links 1860 to define respective pivot axes Z18. A relatively higher portion 1866 of each rocker link 1860 is rotatably connected to the forward stanchion 1816 at a common pivot axis Y18. An upper end 1869 of each rocker link 1860 is sized and configured for grasping.

Right and left rollers 1850 are rotatably mounted on rearward ends of respective foot supporting links 1830. The rollers 1850 are supported by rearward portions of respective drawbars 1840. The foot supporting links 1830 have rearward portions 1834 which are sized and configured to support respective feet of a standing person. The foot supporting links 1830 have forward portions which are rotatably connected to lower ends 1863 of resepective rocker links 1860. More specifically, a forward end of each foot supporting link 1830 is rotatably connected to a respective bracket or collar 1838, which in turn, is connected to the lower end 1863 of a respective rocker link 1860. Each collar 1838 is movable along a respective rocker link 1860 and selectively locked in place by means of a fastener 1839 which inserts into any of a plurality of holes in the rocker link 1860. The foot supporting links 1830 cooperate with the rocker links 1860 (via the collars 1838) to define respective pivot axes X18.

When configured as shown in FIG. 30, the apparatus 1800 links rotation of the cranks 1820 to movement of the foot supports 1834 through generally elliptical paths of motion designated as P18. The rocker links 1860 constrain the pivot axes X18 and Z18 to move in arcuate fashion relative to the frame 1810. The arrangement of the pivot axes X18, Y18, and Z18 is such that the major axis of each path P18 is longer than twice the crank radius. The length of the path P18 may be selectively shortened by moving the collars 1838 upward along the rocker links 1860.

Figure 31:
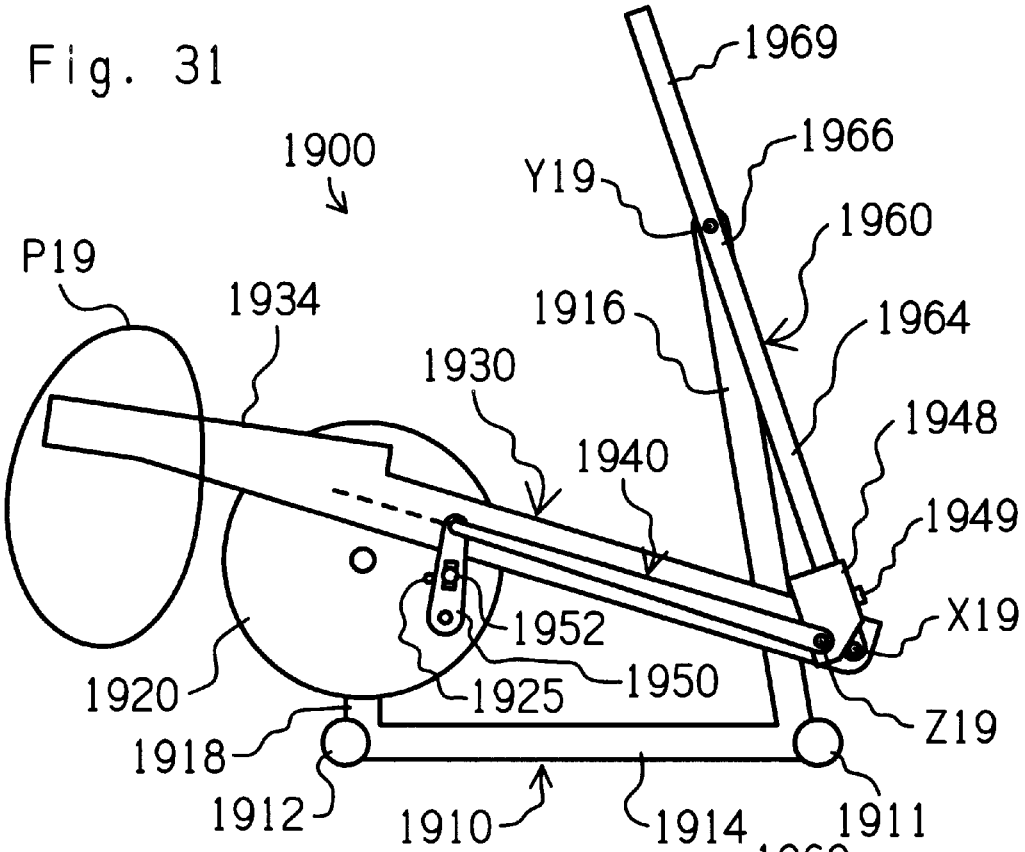
FIG. 31 is a side view of yet another embodiment of the present invention.
Figure 32:
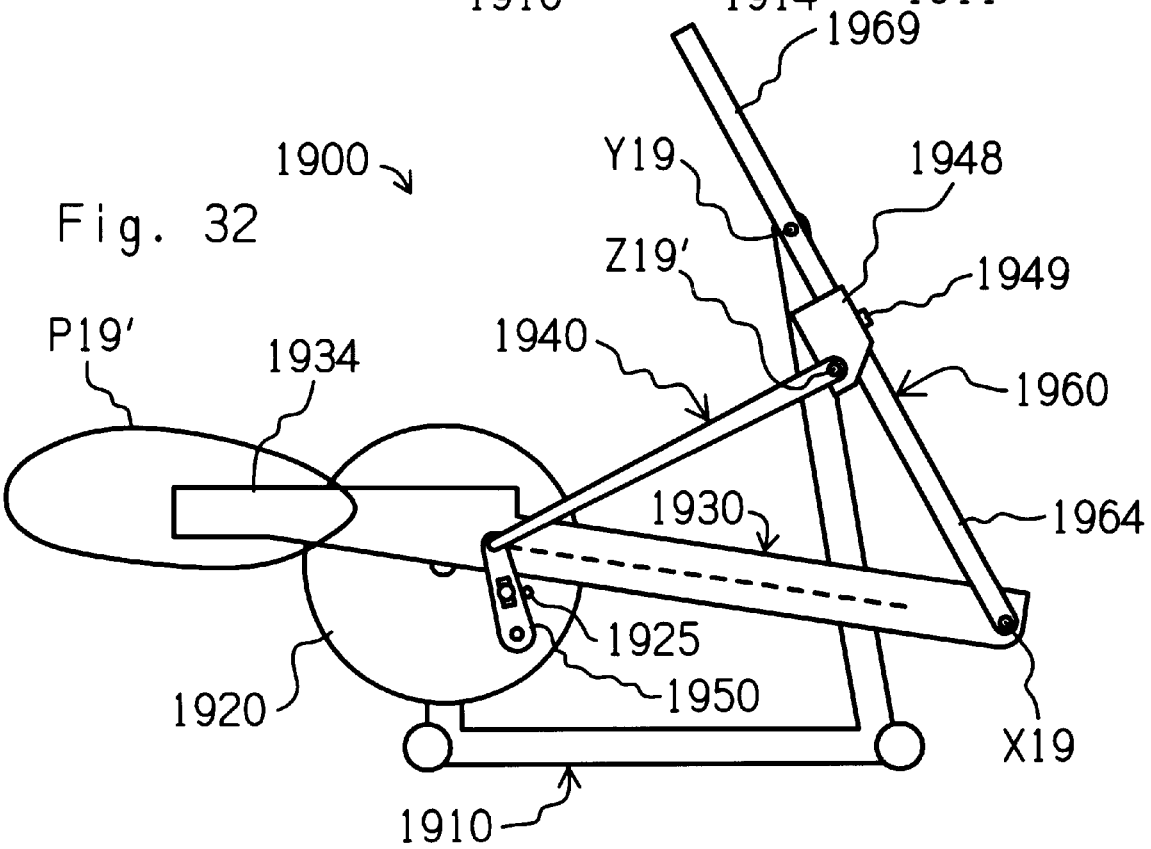
FIG. 32 is a side view of the embodiment of FIG. 31, shown in an alternative configuration which provides a different exercise stroke.

FIGS. 31–32 show an exercise apparatus 1900 having a frame 1910 which includes a base 1914 designed to rest upon a floor surface; a forward stanchion 1916 extending upward from the base 1914 at its forward end 1911; and a rearward stanchion 1918 extending upward from the base 1914 at its rearward end 1912. Left and right flywheels or cranks 1920 are mounted on the stanchion 1918 and rotate relative thereto about a common crank axis.

On each side of the apparatus 1900, an adjustable crank 1950 has a lower end which is rotatably connected to a radially displaced portion of a respective crank 1920. An intermediate portion of each crank 1950 is selectively secured in a desired orientation relative to a respective crank 1920 by means of a fastener 1952 and an aligned hole 1925 in the crank 1920.

An opposite, upper end of each crank 1950 is rotatably connected to a rearward end of a respective drawbar link 1940. An opposite, forward end of each drawbar link 1940 is rotatably connected to an intermediate portion 1964 of a respective handlebar or rocker link 1960. More specifically, a forward end of each drawbar link 1940 is rotatably connected to a respective bracket or collar 1948, which in turn, is connected to the intermediate portion 1964 of a respective rocker link 1960. Each collar 1948 is movable along a respective rocker link 1960 and selectively locked in place by means of a fastener 1949 which inserts into any of a plurality of holes in the rocker link 1960. The drawbar links 1940 cooperate with the rocker links 1960 (via the collars 1948) to define respective pivot axes Z19.

A relatively higher portion 1966 of each rocker link 1960 is rotatably connected to the forward stanchion 1916 at a common pivot axis Y19. An upper end 1969 of each rocker link 1960 is sized and configured for grasping.

Right and left foot supporting links 1930 have rearward portions 1934 which are sized and configured to support respective feet of a standing person; intermediate portions which are movably connected to the upper ends of the cranks 1950 (by means of rollers, for example); and forward portions which are rotatably connected to lower ends of respective rocker links 1960. The foot supporting links 1930 cooperate with the rocker links 1960 to define respective pivot axes X19.

When configured as shown in FIG. 31, with the adjustable cranks 1950 defining a relatively large crank radii, the apparatus 1900 links rotation of the cranks 1920 to movement of the foot supports 1934 through generally elliptical paths of motion designated as P19 which have a generally vertical major axis. The rocker links 1960 constrain the pivot axes X19 and Z19 to move in arcuate fashion relative to the frame 1910. As shown in FIG. 32, the apparatus 1900 may be adjusted so that the adjustable cranks 1950 define relatively smaller crank radii, in order to provide paths of motion designated as P19' which have a generally horizontal major axis. Adjustment of the pivot axes Z19' relatively closer to the pivot axis Y19 and relatively farther from the pivot axes X19 results in greater amplification of the stroke.

Figure 33:
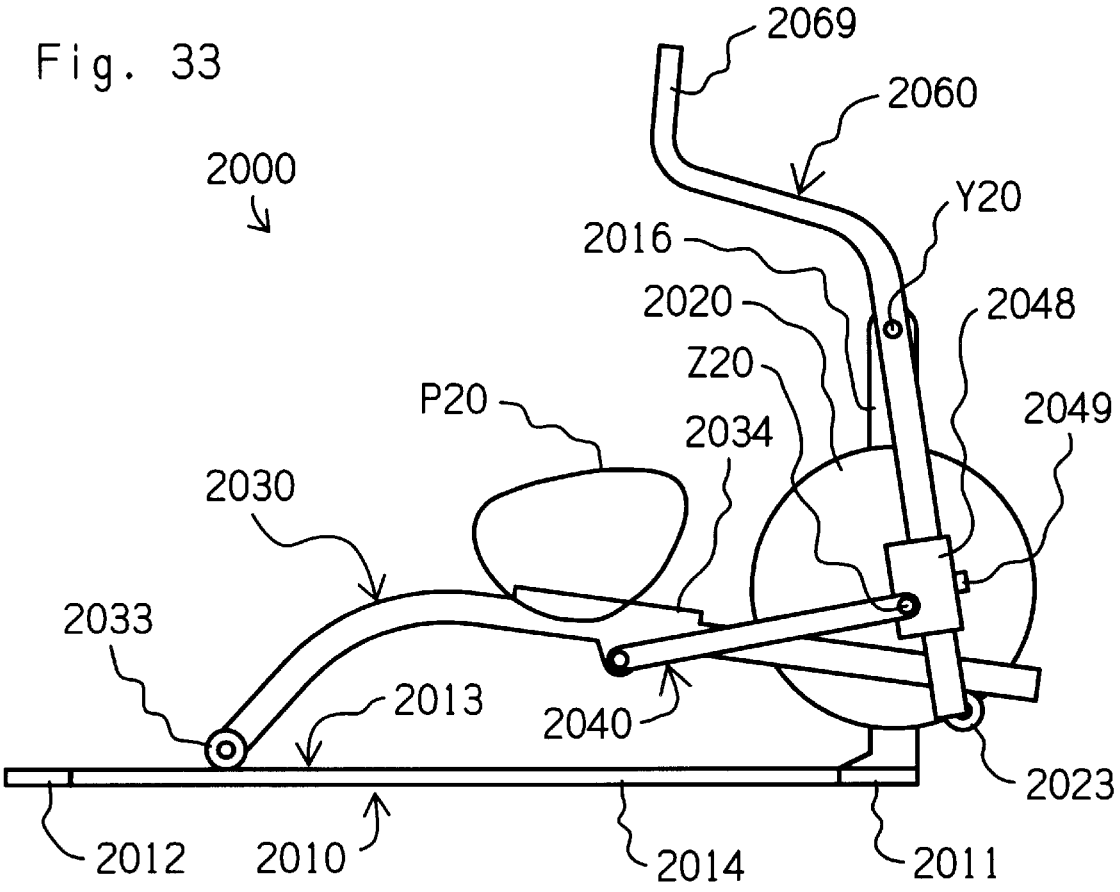
FIG. 33 is a side view of still another embodiment of the present invention.
Figure 34:
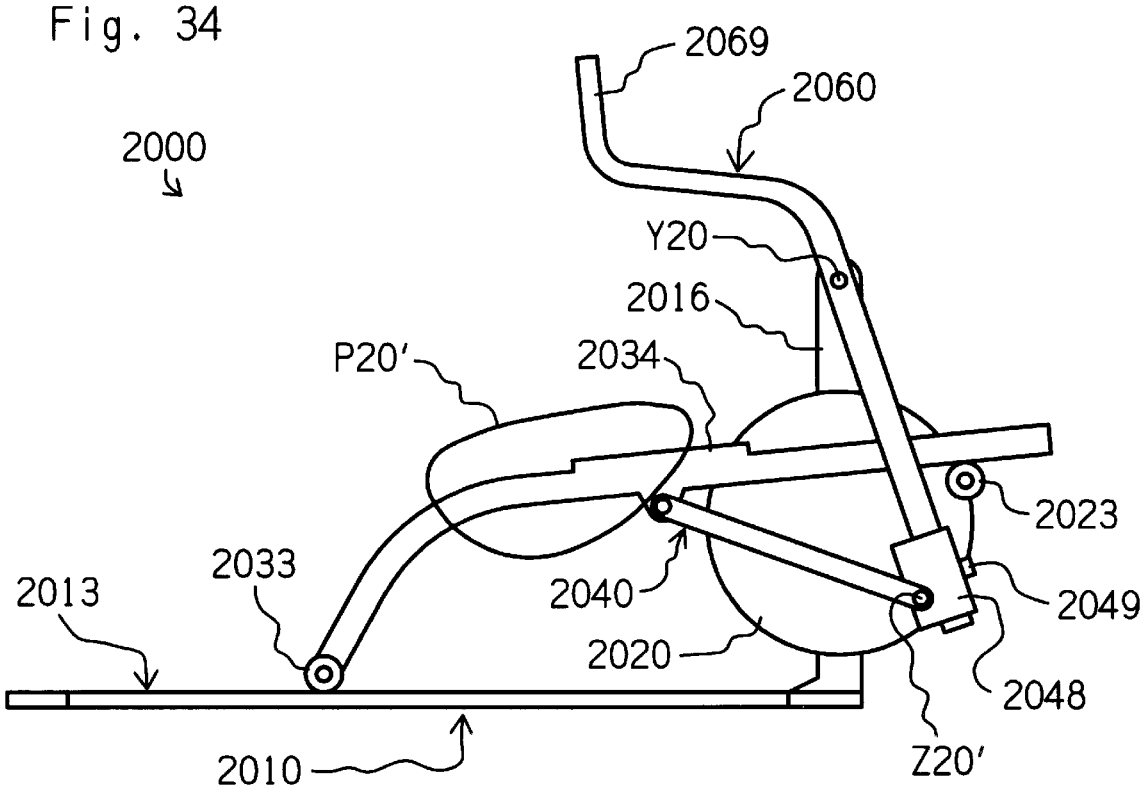
FIG. 34 is a side view of the embodiment of FIG. 33, shown in an alternative configuration which provides a different exercise stroke.
Figure 35:
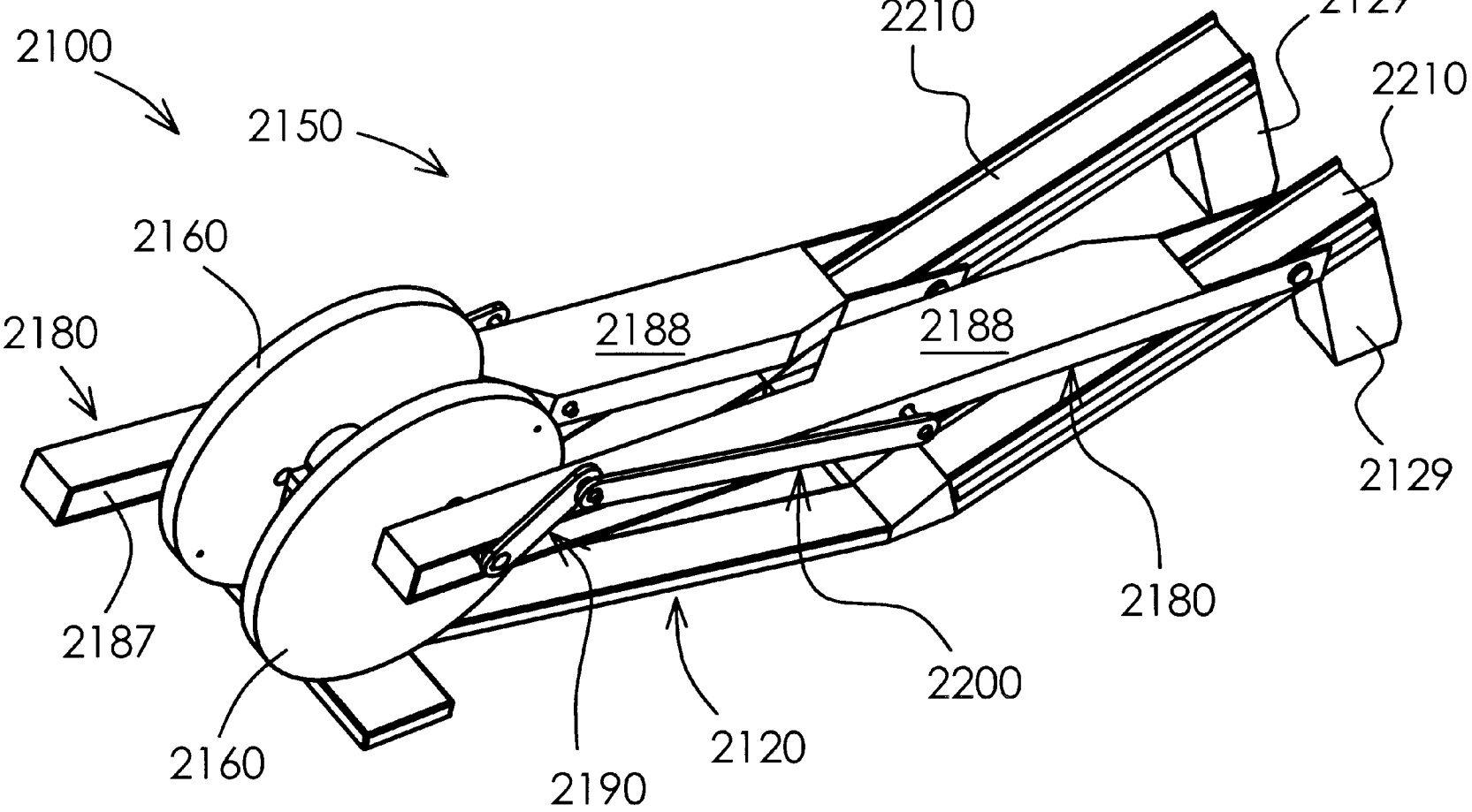
FIG. 35 is a perspective view of another exercise apparatus constructed according to the principles of the present invention.

FIGS. 33–34 show an exercise apparatus 2000 having a frame 2010 which includes a base 2014 that extends between a forward end 2011 and a rearward end 2012 and is designed to rest upon a floor surface; and a forward stanchion 2016 that extends upward from the base 2014 at its forward end 2011. Left and right flywheels or cranks 2020 are rotatably mounted on the forward stanchion 2016 and rotate relative thereto about a common crank axis. Bearing surfaces 2013 are provided on the base 2014 proximate its rearward end 2012.

On each side of the apparatus 2000, a roller 2023 is rotatably connected to a radially displaced portion of a respective crank 1220. Right and left foot supporting links 2030 have forward portions which are supported by respective rollers 2023; intermediate portions 2034 which are sized and configured to support respective feet of a standing person; and rearward ends which are rotatably connected to respective rollers 2033 in contact with respective bearing surfaces 2013.

Right and left drawbar links 2040 have rearward ends which are rotatably connected to the intermediate portions 2034 of respective foot supporting links 2030. An opposite, forward end of each drawbar link 2040 is rotatably connected to a lower portion of a respective handlebar or rocker link 2060. More specifically, a forward end of each drawbar link 2040 is rotatably connected to a respective bracket or collar 2048, which in turn, is connected to the lower portion of a respective rocker link 2060. Each collar 2048 is movable along a respective rocker link 2060 and selectively locked in place by means of a fastener 2049 which inserts into any of a plurality of holes in the rocker link 2060. The drawbar links 2040 cooperate with the rocker links 2060 (via the collars 2048) to define respective pivot axes Z20.

An intermediate portion of each rocker link 2060 is rotatably connected to the forward stanchion 2016 at a common pivot axis Y20. An upper end 2069 of each rocker link 2060 is sized and configured for grasping.

When configured as shown in FIG. 33, the apparatus 2000 links rotation of the cranks 2020 to movement of the foot supports 2034 through generally elliptical paths of motion designated as P20. When configured as shown in FIG. 34, the apparatus 2000 links rotation of the cranks 2020 to movement of the foot supports 2034 through generally elliptical paths of motion designated as P20'. The relatively greater distance between the pivot axis Y20 and the pivot axes Z20' results in a relatively longer stride length.

As with all of the embodiments shown and/or described herein, the apparatus 2000 may be modified in various ways to provide different features and/or exercise motions. For example, an adjustable inclination ramp may be substituted for the bearing surfaces 2013 to provide an exercise path having a selectively adjustable inclination relative to an underlying floor surface; or the rollers 2033 may be rotatably connected to the frame 2010 instead of respective foot supporting links 2030 and then selectively raised and lowered relative to the frame to provide an exercise path having a selectively adjustable inclination relative to an underlying floor surface; or the rearward ends of the foot supporting links may be rotatably connected to respective rocker links supported by a rearward stanchion on the frame.

Another exercise apparatus constructed according to the principles of the present invention is designated as 2100 in FIGS. 35–40. The apparatus 2100 generally includes a frame 2120 and a linkage assembly 2150 movably mounted on the frame 2120. Generally speaking, the linkage assembly 2150 moves relative to the frame 2120 in a manner that links rotation of a flywheel 2160 to generally elliptical motion of a force receiving member 2180.

Figure 36:
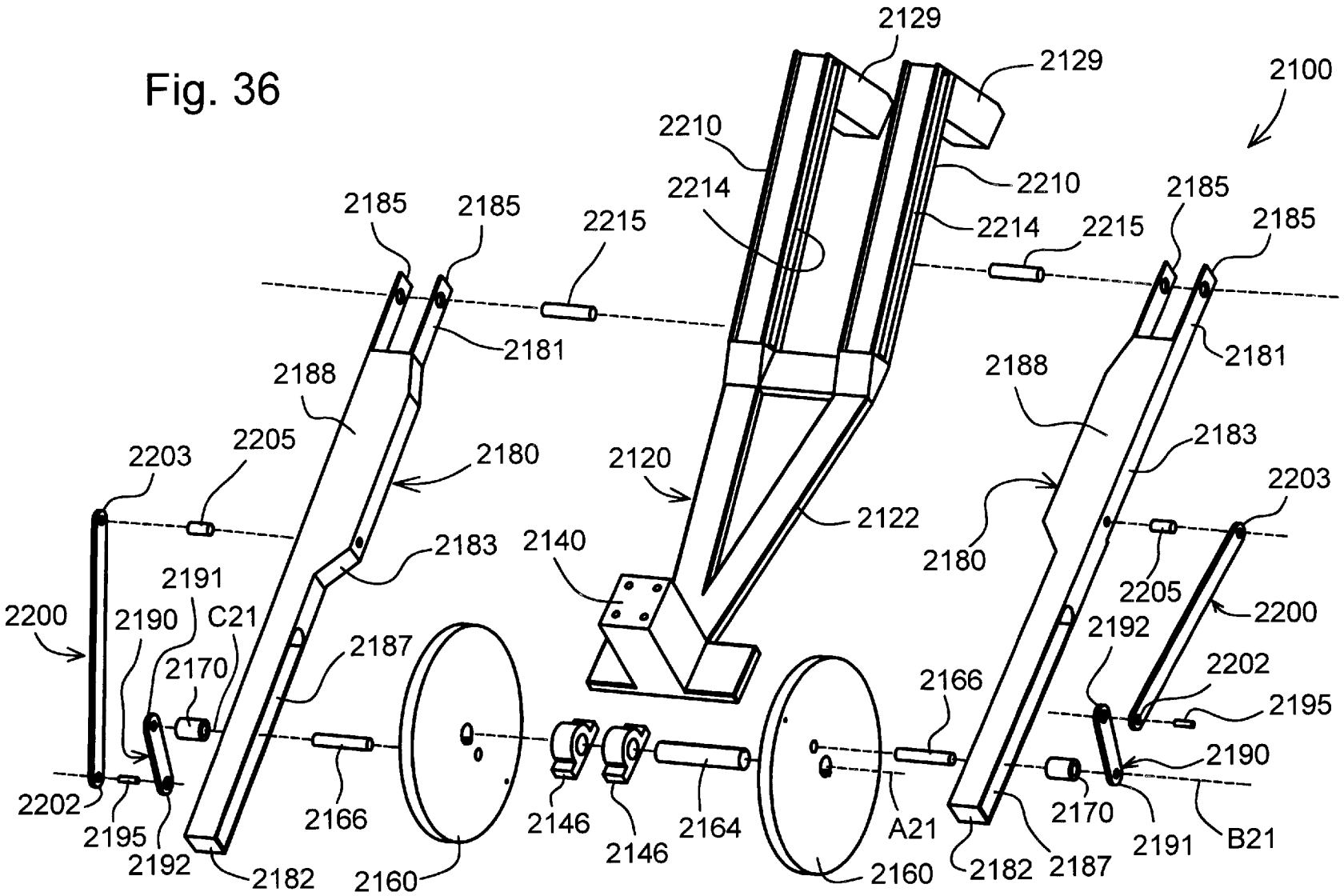
FIG. 36 is an exploded perspective view of the exercise apparatus of FIG. 35.
Figure 37:
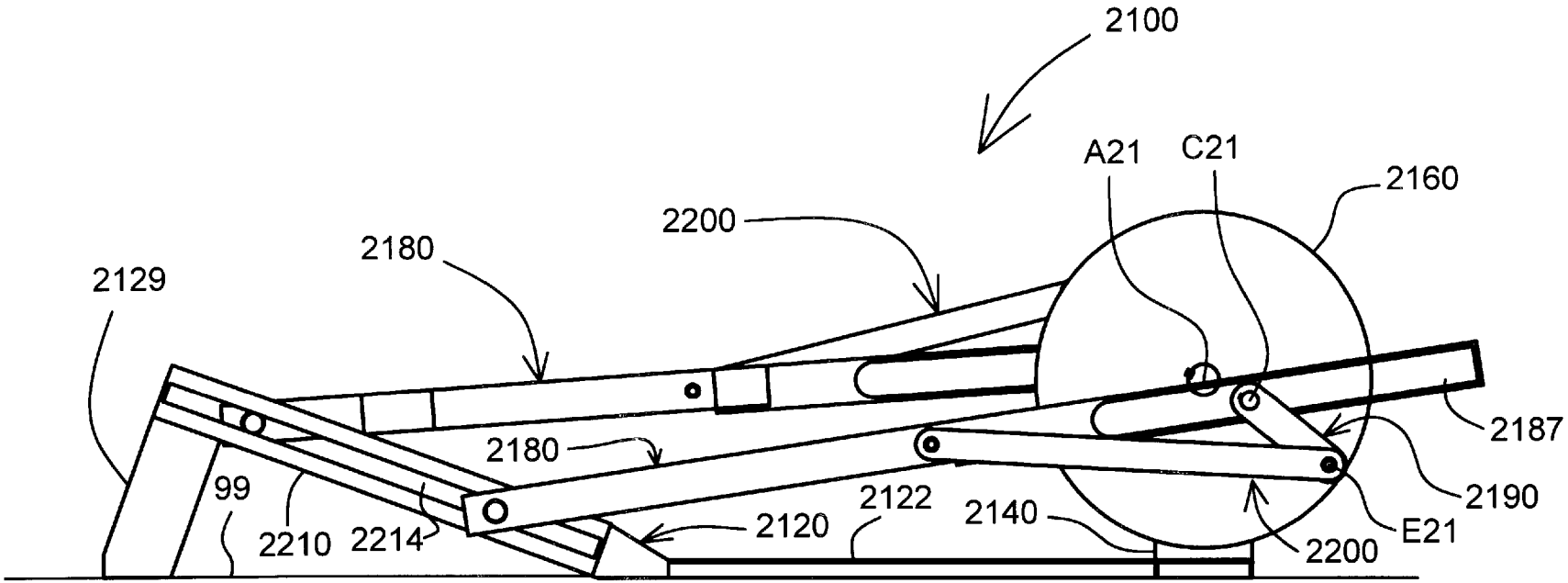
FIG. 37 is a side view of the exercise apparatus of FIG. 35.
Figure 38:
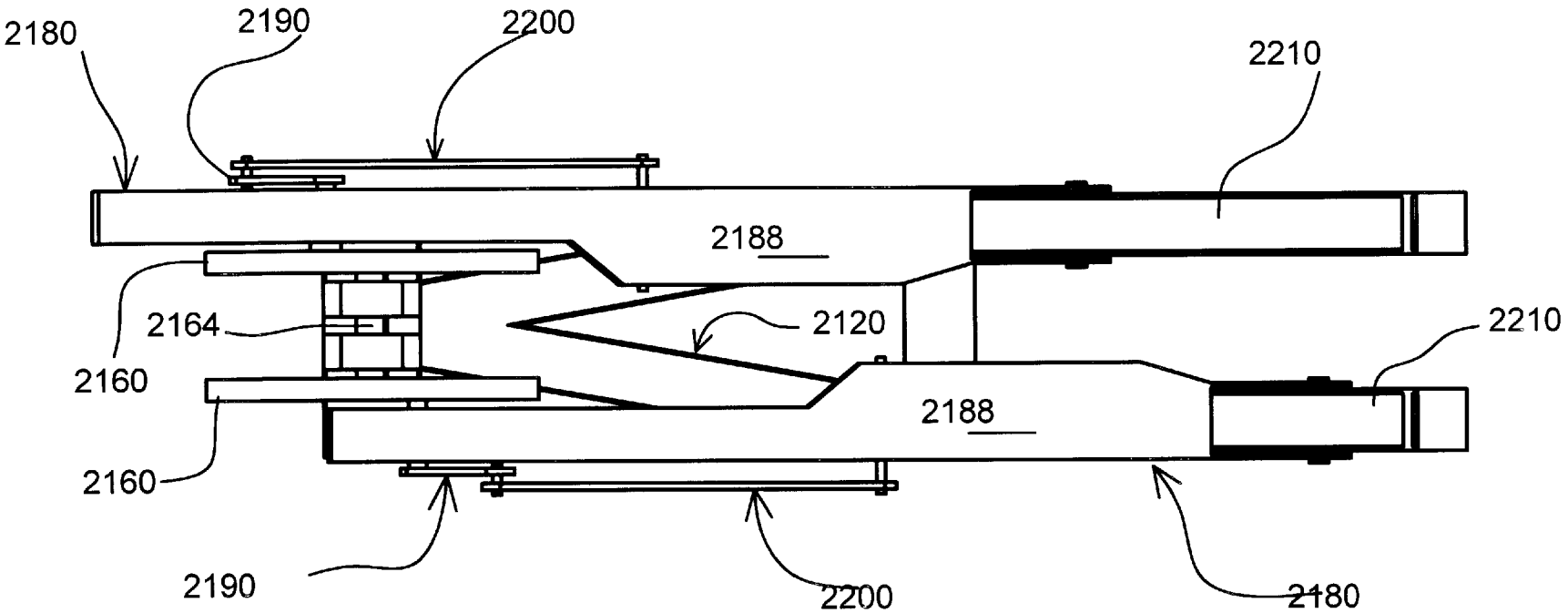
FIG. 38 is a top view of the exercise apparatus of FIG. 35.
Figure 39:
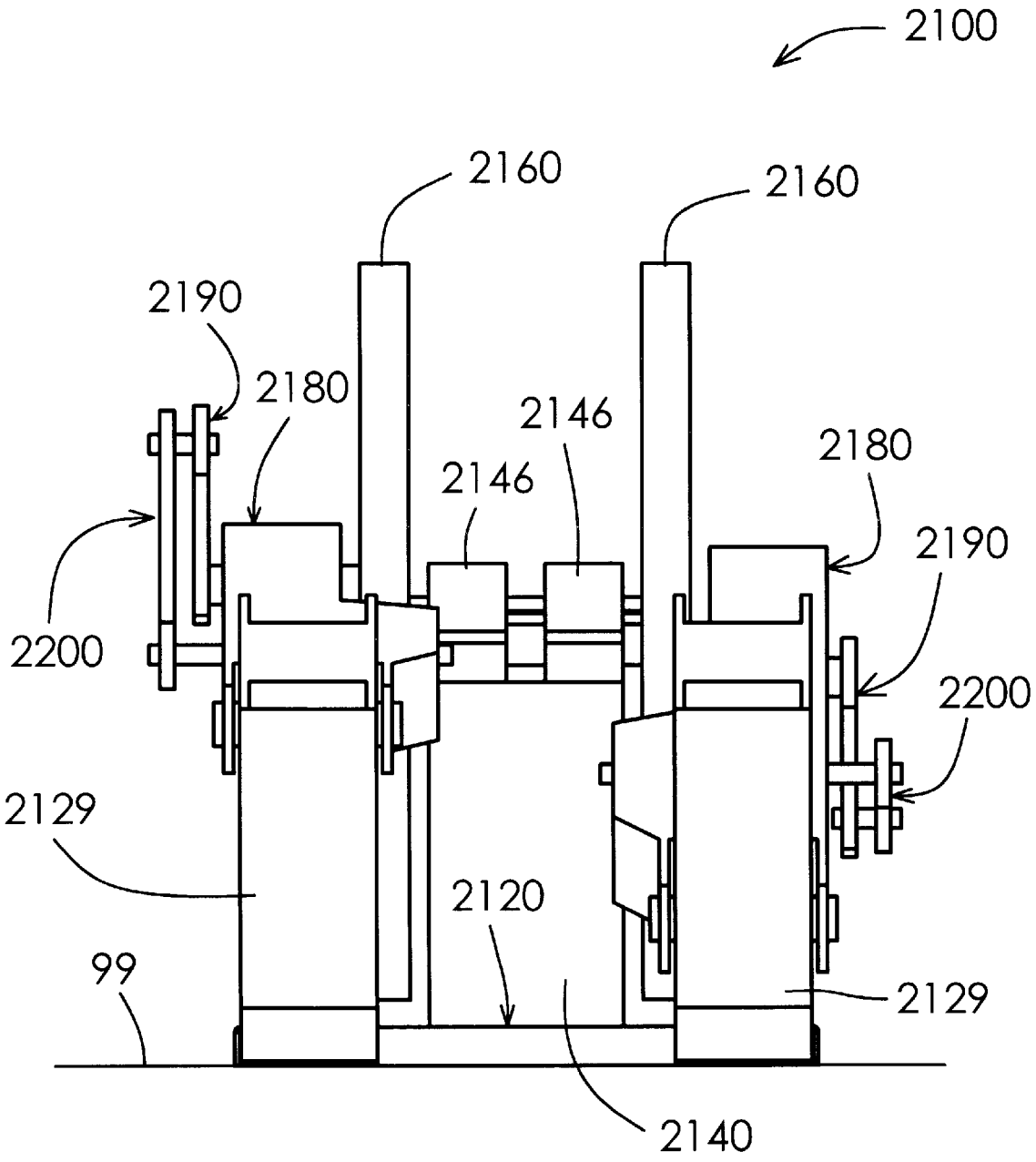
FIG. 39 is a front view of the exercise apparatus of FIG. 35.
Figure 40:
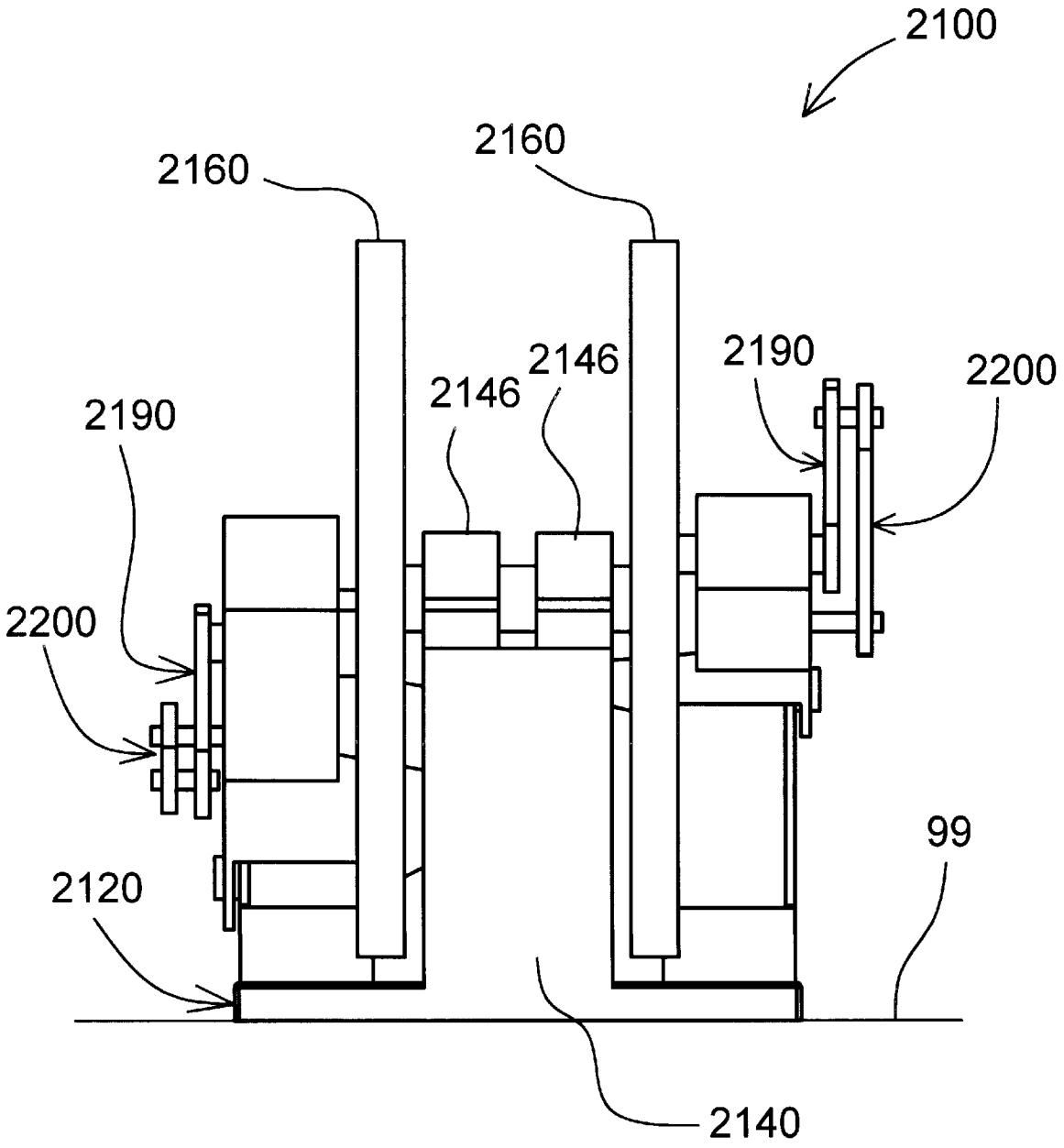
FIG. 40 is a rear view of the exercise apparatus of FIG. 35.
Figure 41A:
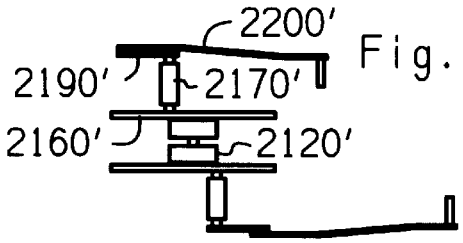
FIG. 41*a* is a top view of part of the linkage assembly on the exercise apparatus of FIG. 35.
Figure 41B:
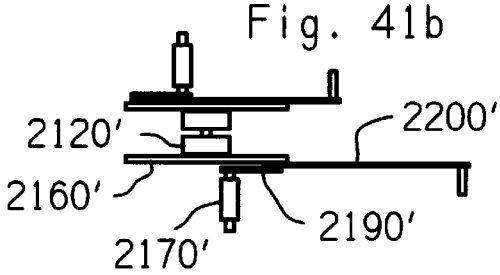
FIG. 41*b* is a top view of a linkage assembly similar to that of FIG. 41*a*, showing a second, discrete arrangement of the linkage assembly components.
Figure 41C:
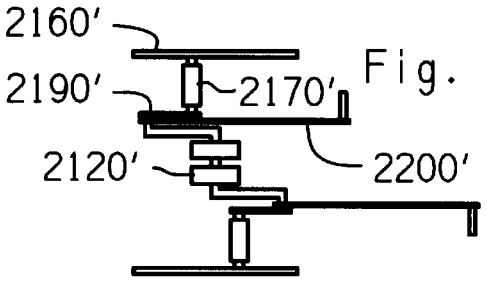
FIG. 41*c* is a top view of a linkage assembly similar to that of FIG. 41*a*, showing a third, discrete arrangement of the linkage assembly components.
Figure 41D:
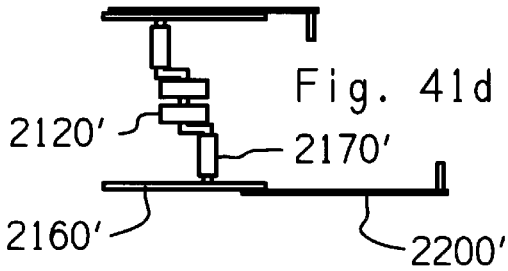
FIG. 41*d* is a top view of a linkage assembly similar to that of FIG. 41*a*, showing a fourth, discrete arrangement of the linkage assembly components.
Figure 41E:
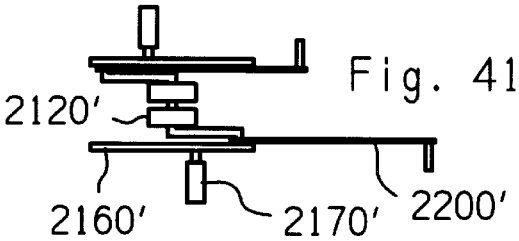
FIG. 41*e* is a top view of a linkage assembly similar to that of FIG. 41*a*, showing a fifth, discrete arrangement of the linkage assembly components.
Figure 41F:
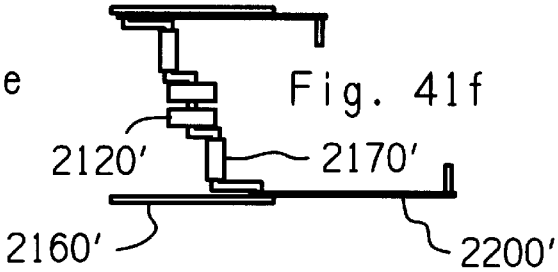
FIG. 41*f* is a top view of a linkage assembly similar to that of FIG. 41*a*, showing a sixth, discrete arrangement of the linkage assembly components.
Figure 41G:
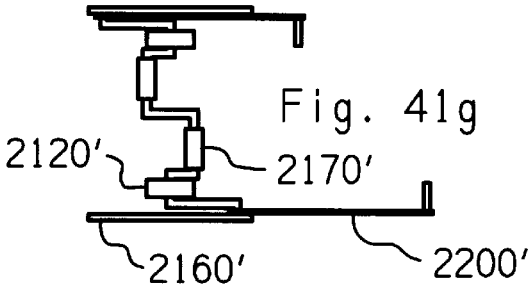
FIG. 41*g* is a top view of a linkage assembly similar to that of FIG. 41*a*, showing a seventh, discrete arrangement of the linkage assembly components.
Figure 41H:
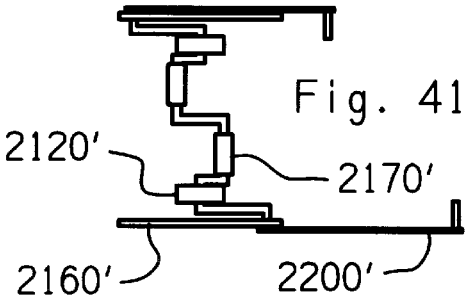
FIG. 41*h* is a top view of a linkage assembly similar to that of FIG. 41*a*, showing an eighth, discrete arrangement of the linkage assembly components.
Figure 41I:
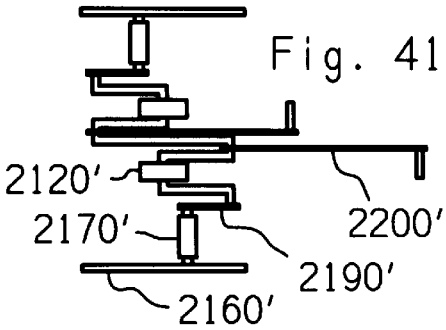
FIG. 41*i* is a top view of a linkage assembly similar to that of FIG. 41*a*, showing a ninth, discrete arrangement of the linkage assembly components.
Figure 41J:
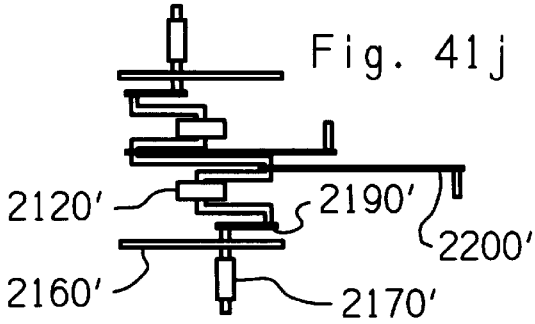
FIG. 41*j* is a top view of a linkage assembly similar to that of FIG. 41*a*, showing a tenth, discrete arrangement of the linkage assembly components.

The frame 2120 includes a base 2122 which is designed to rest upon a generally horizontal floor surface 99. As shown in FIG. 36, a rearward stanchion 2140 extends perpendicularly upward from the base 2122 and supports a pair of bearing assemblies 2146. An axle 2164 is inserted through holes (not numbered) in the bearing assemblies 2146 to support a pair of flywheels 2160 in a manner known in the art. For example, the axle 2164 may be inserted through the bearing assemblies 2146, and then one of the flywheels 2160 may be fixed to each of the protruding ends of the axle 2164, on opposite sides of the stanchion 2140. Those skilled in the art will recognize that the flywheels 2160 could be replaced by some other rotating member(s) which may or may not, in turn, be connected to one or more flywheels. These rotating members 2160 rotate about an axis designated as A21.

On each side of the apparatus 2100, a radially displaced shaft 2166 is rigidly secured to the flywheel 2160 by means known in the art. For example, the shaft 2166 may be inserted into a hole (not numbered) in the flywheel 2160 and welded in place. The shaft 2166 is secured to the flywheel 2160 at a point radially displaced from the axis A21, and thus, the shaft 2166 rotates at a fixed radius about the axis A21. In other words, the shaft 166 and the flywheel 2160 cooperate to define a first crank having a first crank radius.

A roller 2170 is rotatably mounted on the shaft 2166. The roller 2170 on the right side of the apparatus 2100 (from the perspective of a user facing away from the flywheels 2160) rotates about an axis B21, and the roller 2170 on the left side of the apparatus 2100 rotates about an axis C21. In the embodiment 2100, each of the rollers 2170 has a smooth cylindrical surface which bears against and supports a rearward portion or end 2182 of a respective force receiving member 2180. In particular, the roller 2170 protrudes laterally into a slot 2187 provided in the rearward end 2182 of the force receiving member 2180. The height of the slot 2187 is greater than the diameter of the roller 2170, so the lower surface of the slot 2187 does not prevent the roller 2170 from rolling back and forth across the upper surface of the slot 2187. Other structures (e.g. the shaft 2166 alone) could be used in place of the roller 2170. In any event, the roller may be said to be interconnected between the flywheel 2160 and the force receiving member 2180 and/or to provide a means for interconnecting the flywheel 2160 and the force receiving member 2180.

A rigid member or first link 2190 has a first end 2191 which is fixedly secured to the distal end of the shaft 2166 by means known in the art. The first link 2190 extends to a second, opposite end 2192 which occupies a position radially displaced from the axis A21, and which rotates at a fixed radius about the axis A21. In other words, the second end 2192 of the first 2190 and the flywheel 2160, together with the parts interconnected therebetween, cooperate to define an effective crank radius which is longer than the crank radius defined between the shafts 2166. Those skilled in the art will recognize that the two "cranks" are portions of a single unitary member which is connected to the flywheel 2160 by the shaft 2166, and they share a common rotational axis A21.

A second link 2200 has a rearward end 2202 rotatably connected to the second end 2192 of the first link 2190 by means known in the art. For example, holes may be formed through the overlapping ends 2192 and 2202, and a fastener 2195 may be inserted through the aligned holes and secured in place. As a result of this arrangement, the second link 2200 on one side of the apparatus 2100 rotates about an axis D21 relative to its respective fastener 2195 and flywheel 2160; and the second link 2200 on the other side of the apparatus 2100 rotates about an axis E21 relative to its respective fastener 2195 and flywheel 2160. Those skilled in the art will recognize that the exact location of the axes D21 and E21 relative to the other axes A21, B21, and C21, as well as one another, is a matter of design choice.

The second link 2200 has a forward end 2203 rotatably connected to an intermediate portion 2183 of the force receiving member 2180 by means known in the art. For example, a pin 2205 may be secured to the force receiving member 2180, and a hole may be formed through the forward end 2203 of the second link 2200 to receive the pin 2205. As a result of this arrangement, the second link 2200 may be said to be rotatably interconnected between the flywheel 2160 and the force receiving member 2180, and/or to provide a discrete means for interconnecting the flywheel 2160 and the force receiving member 2180.

Each force receiving member 2180 has a forward end 2181 which is movably connected to the frame 2120, as well as a rearward end 2182 (connected to the roller 2170) and an intermediate portion 2183 (connected to the second link 2200). In this regard, right and left rails or supports 2210 extend from relatively rearward ends, which are connected to the base 2122 proximate the floor surface 99, to relatively forward ends, which are supported above the floor surface 99 by posts 2129. A longitudinally extending slot 2214 is provided in each rail 2210 to accommodate a respective bearing member 2215. The forward end 2181 of each force receiving member 2180 is provided with opposing flanges 2185 which occupy opposite sides of a respective rail 2210 and are connected to opposite ends of a respective bearing member 2215. In other words, the bearing member 2215 movably connects the force receiving member 2180 to the rail 2210 and/or may be described as a means for interconnecting the force receiving member 2180 and the frame 2120.

In the embodiment 2100, the bearing member 2215 is a roller which is rotatably mounted on the force receiving member 2180 and rollable across a bearing surface within the slot 2214. However, the bearing member could instead be a stud which is rigidly secured to the force receiving member and slidable across a bearing surface within the slot. The intermediate portion 2183 of the force receiving member 2180 may be described as that portion between the first end 2181 and the second end 2182. In addition to connecting with the second link 2200, the intermediate portion 2183 provides a support surface 2188 which is sized and configured to support at least one foot of a person using the apparatus 2100.

In operation, rotation of the flywheel 2160 causes the shaft 2166 to revolve about the axis A21, and the roller 2170 causes the support surface 2188 to move up and down relative to the frame 2120, through a range of motion approximately equal to the crank diameter (or twice the radial distance between the axis A21 and either axis B21 or C21). Rotation of the flywheel 2160 also causes the second end 2192 of the first link 2190 to revolve about the axis A21, and the second link 2200 causes the support surface 2188 to move back and forth relative to the frame 2120, through a range of motion approximately equal to twice the radial distance between the axes D21 and E21 (which is greater than the crank diameter defined between B21 and C21).

The present invention provides an apparatus and method for moving a force receiving member through a path having a horizontal component which is not necessarily related to or limited by the vertical component. As a result, it is a relatively simple matter to design an apparatus with a desired "aspect ratio" for the elliptical path to be traveled by the foot platform. For example, movement of the axes D21 and E21 farther from the axis A21 and/or movement of the axes B21 and C21 closer to the axis A21 will result in a relatively flatter path of motion. Ultimately, the exact size, configuration, and arrangement of the components of the linkage assembly 150 are a matter of design choice.

Those skilled in the art will further recognize that the above-described components of the linkage assembly 2150 may be arranged in a variety of ways. For example, in each of FIGS. 41*a*–41*j*, flywheels 2160', support rollers 2170', links 2190', and links 2200' are shown in several alternative configurations relative to one another and the frame 2120' (in some embodiments, there is no need for a discrete link 2190' because both the links 2200' and the rollers 2170' are connected directly to the flywheels 2160').

Figure 42:
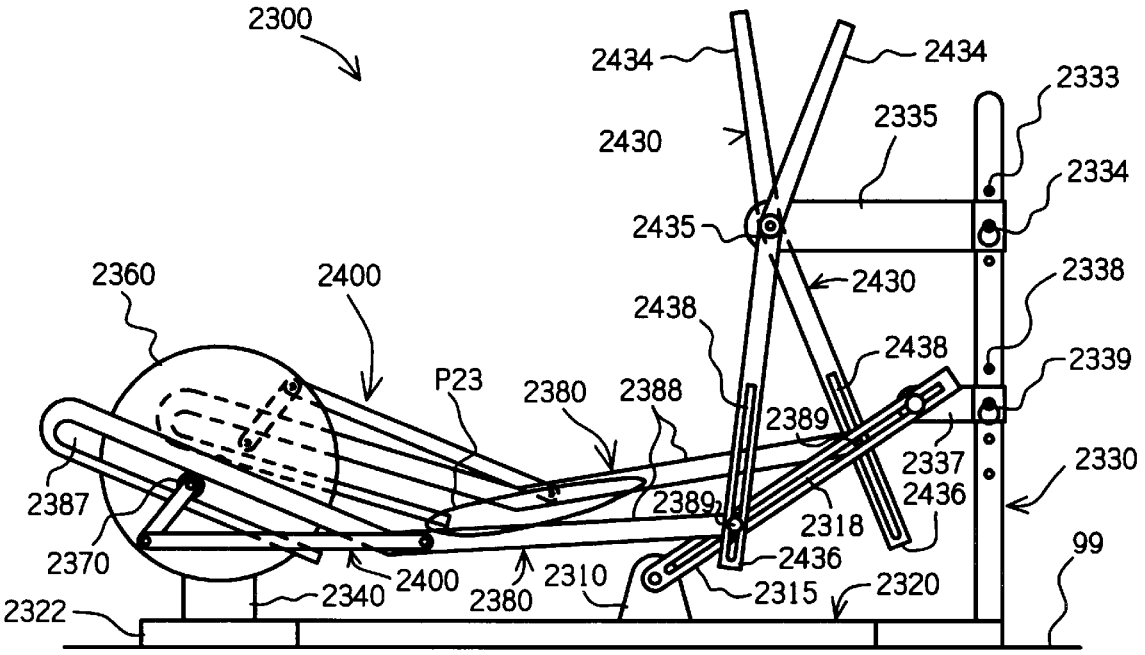
FIG. 42 is a side view of another embodiment of the present invention.

Another embodiment of the present invention is designated as 2300 in FIG. 42. The exercise apparatus 2300 includes a frame 2320 having a base 2322, a forward stanchion 2330, a rearward stanchion 2340, and an intermediate stanchion 2310. When the base 2322 is resting upon a floor surface 99, each of the stanchions 2310, 2330, 2340 extends generally upward from the base 2322.

A flywheel 2360 is rotatably mounted on the rearward stanchion 2340, and a roller 2370 is rotatably mounted on the flywheel 2360 at a first radially displaced location. A rearward portion of a force receiving member 2380 rests upon the roller 2370. In particular, the rearward portion of the force receiving member is configured to define a slot 2387, and the roller 2370 protrudes laterally into the slot 2387 and bears against the upper wall or surface which borders the slot 2387.

An intermediate portion of the force receiving member 2380 extends at an obtuse angle from the rearward portion and provides a foot supporting surface 2388. A first end of a rigid link 2400 is rotatably connected to the flywheel 2360 at a second radially displaced location. A second, opposite end of the link 2400 is rotatably connected to the intermediate portion of the force receiving member 2380.

A roller 2389 is rotatably mounted on a forward end of the force receiving member 2380. The roller 2389 rolls or bears against a ramp 2315 having a first end rotatably connected to the intermediate stanchion 2310, and a second, opposite end connected to a trunnion 2337. A slot 2318 is provided in the ramp 2315 both to accommodate the roller 2389 and to facilitate angular adjustment of the ramp 2315 relative to the frame 2320 and the floor surface 99. With regard to the latter function, the trunnion 2337 is slidably mounted on the forward stanchion 2330, and a pin 2339 may be selectively inserted through aligned holes 2338 in the trunnion 2337 and the stanchion 2330 to secure the trunnion 2337 in any of several positions above the floor surface 99. As the trunnion 2337 slides downward, the fastener which interconnects the trunnion 2337 and the ramp 2315 is free to move within the slot 2318.

A lower portion 2436 of a handle member 2430 is movably connected to the forward end of the force receiving member 2380, adjacent the roller 2389. In particular, a common shaft extends through the force receiving member 2380, the roller 2389, and a slot 2438 provided in the lower portion 2436. An opposite, upper end of the handle member 2430 is sized and configured for grasping by a person standing on the force receiving member 2380. An intermediate portion 2435 of the handle member 2430 is rotatably connected to a trunnion 2335 which in turn, is slidably mounted on the forward stanchion 2330 above the trunnion 2337. A pin 2334 may be selectively inserted through any one of the holes 2333 in the trunnion 2335 and an aligned hole in the stanchion 2330 to secure the trunnion 335 in any of several positions above the floor surface 99. The slot 2438 in the handle member 2430 both accommodates height adjustments and allows the handle member 2430 to pivot about its connection with the trunnion 2335 while the roller 2389 moves through a linear path of motion. As a result of this arrangement, the height of the handle member 2430 can be adjusted without affecting the path of the foot support 2380, and/or the path of the foot support 2380 can be adjusted without affecting the height of the handle member 2430, even though the two force receiving members 2380 and 2430 are linked to one another.

In view of the foregoing, the apparatus 2300 may be said to include means for linking rotation of a crank 2360 to generally elliptical motion of a force receiving member 2380 (through a path P23), and/or means for linking the generally elliptical motion of the force receiving member 2380 to reciprocal motion of another force receiving member 2430.

Figure 43:
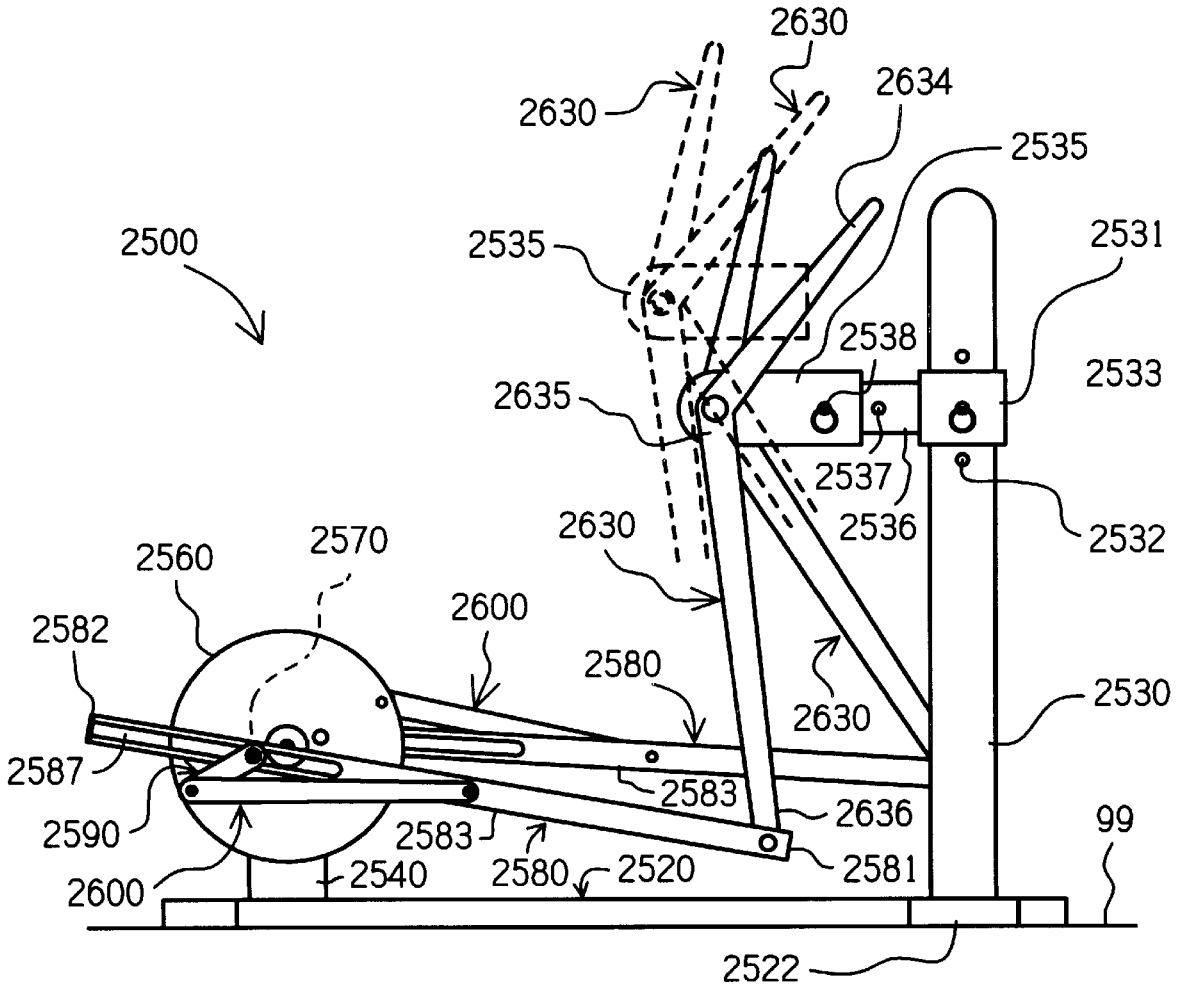
FIG. 43 is a side view of yet another embodiment of the present invention.

Yet another embodiment of the present invention is designated as 2500 in FIG. 43. The exercise apparatus 2500 includes a frame 2520 having a base 2522, a forward stanchion 2530, and a rearward stanchion 2540. The base 2522 is configured to rest upon a floor surface 99, and each of the stanchions 2530 and 2540 to extend generally perpendicularly upward from the base 2522.

A flywheel 2560 is rotatably mounted on the rearward stanchion 2540, and a roller 2570 is rotatably mounted on the flywheel 2560 at a first radially displaced location. A rearward portion 2582 of a force receiving member 2580 rests upon the roller 2570. In particular, the rearward portion 2582 of the force receiving member 2580 is configured to define a slot 2587, and the roller 2570 protrudes laterally into the slot 2587 and bears against the upper wall or surface which borders the slot 2587.

A first rigid link 2590 has a first end rigidly secured to the shaft which supports the roller 2570, and a second, opposite end which occupies a second radially displaced position relative to the crank axis. A first end of a second rigid link 2600 is rotatably connected to the second end of the first link 2590. A second, opposite end of the link 2600 is rotatably connected to an intermediate portion 2583 of the force receiving member 2580. The intermediate portion 2583 is sized and configured to support a person's foot.

A forward end 2581 of the force receiving member 2580 is rotatably connected to a lower end 2636 of a third link or pivoting handle member 2630. An opposite, upper end 2634 of the handle member 2630 is sized and configured for grasping by a person standing on the intermediate portion 2583 of the force receiving member 2580. An intermediate portion 2635 of the handle member 2630 is rotatably connected to a trunnion 2535 on the frame 2520. The trunnion 2535 is slidably mounted on a laterally extending support 2536, which in turn, is slidably mounted on the forward stanchion 2530. A pin 2533 inserts through aligned holes 2532 in the stanchion 2530 and the support 2536 to secure the support 2536 (and the trunnion 2535) at any one of a plurality of distances above the floor surface 99. A pin 2538 inserts through aligned holes 2537 in the support 2536 and the trunnion 2535 to secure the trunnion 2535 at one of a plurality of distances from the forward stanchion 2530. As a result of this arrangement, the handle member 2630 may be said to be rotatably interconnected between the force receiving member 2580 and the frame 2520 and/or to provide a means for interconnecting the force receiving member 2580 and the frame 2520. The handle member 2630 may also be said to be rotatably interconnected between the force receiving member 2580 and the frame 2520, and/or to provide a means for interconnecting the force receiving member 2580 and the frame 2520.

Recognizing that the foregoing description and drawings set forth only some of the numerous possible embodiments and variations of the present invention, and that numerous other modifications and interchanging of features are likely to be recognized by those skilled in the art, the scope of the present invention is to be limited only to the extent of the claims which follow.

What is claimed is:

1. An exercise apparatus, comprising:

a frame adapted to rest upon a floor surface;

a left rotating member and a right rotating member, wherein each said rotating member is rotatably mounted on a rearward end of the frame, and each said rotating member rotates about a common axis relative to the frame;

a left axially extending support and a right axially extending support, wherein each said axially extending support is mounted on a respective rotating member at a radial distance from the common axis;

a left foot supporting linkage movably interconnected between the frame and the left axially extending support and including a left foot support;

a right foot supporting linkage movably interconnected between the frame and the right axially extending support and including a right foot support, wherein each said foot support has a forward portion constrained to move in reciprocal fashion relative to the frame, an intermediate portion sized and configured to support a person's foot, and a rearward portion movably supported on a respective axially extending support;

a left means, interconnected between the left axially extending support and the left foot supporting linkage, for linking rotation of the left rotating member to back and forth movement of the left foot support; and a right means, interconnected between the right axially extending support and the right foot supporting linkage, for linking rotation of the right rotating member to back and forth movement of the right foot support.

2. The exercise apparatus of claim 1, wherein each said axially extending support includes a roller rotatably mounted on a respective rotating member.

3. The exercise apparatus of claim 1, wherein a portion of each said means is constrained to rotate about the common axis at a radius which is greater than the radial distance.

4. The exercise apparatus of claim 1, wherein each said means includes a drawbar link pivotally connected to the intermediate portion of a respective foot link.

5. The exercise apparatus of claim 1, wherein each said foot supporting linkage includes a rocker link pivotally interconnected between the frame and the forward portion of a respective foot link.

6. The exercise apparatus of claim 1, wherein each said means constrains a respective foot support to move back and forth through a distance which exceeds twice the radial distance.

7. An exercise apparatus, comprising:

a frame adapted to rest upon a floor surface;

a left rotating member and a right rotating member, wherein each said rotating member is rotatably mounted on a rearward end of the frame, and each said rotating member rotates about a common axis relative to the frame;

a left axially extending support and a right axially extending support, wherein each said axially extending support is mounted on a respective rotating member at a radial distance from the common axis;

a left foot supporting linkage movably interconnected between the frame and the left axially extending support and including a left foot support;

a right foot supporting linkage movably interconnected between the frame and the right axially extending support and including a right foot support, wherein each said foot support has a forward portion constrained to move in reciprocal fashion relative to the frame, an intermediate portion sized and configured to support a person's foot, and a rearward portion movably supported on a respective axially extending support;

a left drawbar link and a right drawbar link, wherein each said drawbar link has a rearward portion constrained to rotate about the common axis, and a forward portion pivotally connected to a respective foot supporting linkage.

8. The exercise apparatus of claim 7, wherein each said axially extending support includes a roller rotatably mounted on a respective rotating member.

9. The exercise apparatus of claim 7, wherein the rearward portion of each said drawbar link is constrained to rotate about the common axis at a radius which is greater than the radial distance.

10. The exercise apparatus of claim 7, wherein the forward portion of each said drawbar link is pivotally connected to the intermediate portion of a respective foot link.

11. The exercise apparatus of claim 7, wherein each said foot supporting linkage includes a rocker link pivotally interconnected between the frame and the forward portion of a respective foot link.

12. The exercise apparatus of claim 7, wherein each said drawbar link constrains a respective foot support to move back and forth through a distance which exceeds twice the radial distance.

13. An exercise apparatus, comprising:

a frame adapted to rest upon a floor surface;

a left rotating member and a right rotating member, wherein each said rotating member is rotatably mounted on a rearward end of the frame, and each said rotating member rotates about a common axis relative to the frame;

a left axially extending support and a right axially extending support, wherein each said axially extending support is mounted on a respective rotating member at a radial distance from the common axis;

a left foot supporting linkage movably interconnected between the frame and the left axially extending support, wherein the left foot supporting linkage includes a left rocker link having an upper portion and a lower portion, and a left foot link having a forward portion, a rearward portion, and an intermediate portion sized and configured to support a person's left foot;

a right foot supporting linkage movably interconnected between the frame and the right rotating member, wherein the right foot supporting linkage includes a right rocker link having an upper portion and a lower portion, and a right foot link having a forward portion, a rearward portion, and an intermediate portion sized and configured to support a person's right foot, wherein the upper portion of each said rocker link is pivotally connected to a forward end of the frame, and the lower portion of each said rocker link is pivotally connected to the forward portion of a respective foot link, and the rearward portion of each said foot link is movably supported by a respective axially extending support; and a left drawbar link and a right drawbar link, wherein each said drawbar link is interconnected between a respective axially extending support and a respective foot supporting linkage.

14. The exercise apparatus of claim 1, wherein each said axially extending support includes a roller rotatably mounted on a respective rotating member.

15. The exercise apparatus of claim 1, wherein a rearward portion of each said drawbar link is constrained to rotate about the common axis at a radius which is greater than the radial distance.

16. The exercise apparatus of claim 1, wherein each said drawbar link is pivotally connected to the intermediate portion of a respective foot link.

17. The exercise apparatus of claim 1, wherein each said drawbar link constrains a respective foot link to move back and forth through a distance which is greater than twice the radial distance.

18. An exercise apparatus, comprising:

a frame adapted to rest upon a floor surface;

a left rotating member and a right rotating member, wherein each said rotating member is rotatably mounted on a rearward portion of said frame, and each said rotating member rotates about a common axis relative to said frame;

first and second connection points on said left rotating member, and first and second connection points on said right rotating member, wherein each of said first connection points is disposed at a first radial distance from said common axis, and each of said second connection points is disposed at a second radial distance from said common crank axis;

a left foot linkage and a right foot linkage, wherein each said foot linkage includes a foot engaging portion, a forward portion movably connected to a forward portion of said frame and constrained to move in reciprocal fashion relative thereto, and a rearward portion movably connected to a respective one of said first connection points; and a left drawbar and a right drawbar, wherein each said drawbar has a rearward portion pivotally connected to a respective one of said second connection points, and a forward portion pivotally connected to a respective foot linkage.

19. The exercise apparatus of claim 18, wherein said forward portion of each said drawbar is connected to a respective foot engaging portion.

20. The exercise apparatus of claim 18, wherein said second radial distance is greater than said first radial distance.

21. The exercise apparatus of claim 18, wherein said forward portion of each said foot linkage includes a roller which rolls along said frame.

22. The exercise apparatus of claim 18, wherein said forward portion of each said foot linkage includes a rocker link which is pivotally connected to said frame.

23. The exercise apparatus of claim 18, wherein each of said first connection points is defined by a roller rotatably mounted on a respective rotating member and disposed beneath said rearward portion of a respective foot linkage.

* * * * *